US006527376B1

(12) United States Patent
Itaya et al.

(10) Patent No.: US 6,527,376 B1
(45) Date of Patent: Mar. 4, 2003

(54) LIQUID-EJECTING HEAD, LIQUID-EJECTING METHOD AND LIQUID-EJECTING PRINTING APPARATUS

(75) Inventors: Tamon Itaya, Tokyo (JP); Koichi Kitakami, Chigasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/472,797

(22) Filed: Dec. 28, 1999

(30) Foreign Application Priority Data

Dec. 29, 1998 (JP) ..... 10-377652
Apr. 27, 1999 (JP) ..... 11-120723

(51) Int. Cl.[7] ..... B41S 2/05
(52) U.S. Cl. ..... 347/56
(58) Field of Search ..... 347/47, 56, 63

(56) References Cited

U.S. PATENT DOCUMENTS

| | | | | |
|---|---|---|---|---|
| 4,345,262 A | | 8/1982 | Shirato et al. | |
| 4,459,600 A | | 7/1984 | Sato et al. | |
| 4,463,359 A | | 7/1984 | Ayata et al. | |
| 4,558,333 A | | 12/1985 | Sugitani et al. | |
| 4,723,129 A | | 2/1988 | Endo et al. | |
| 4,740,796 A | | 4/1988 | Endo et al. | |
| 4,967,208 A | * | 10/1990 | Childers | 347/56 |
| 5,389,962 A | | 2/1995 | Sekiya et al. | 347/65 |
| 5,754,202 A | | 5/1998 | Sekiya et al. | 347/63 |

FOREIGN PATENT DOCUMENTS

| | | |
|---|---|---|
| JP | 54-56847 | 5/1979 |
| JP | 59-123670 | 7/1984 |
| JP | 59-138461 | 8/1984 |
| JP | 60-71260 | 4/1985 |
| JP | 4-10941 | 1/1992 |

* cited by examiner

*Primary Examiner*—John Barlow
*Assistant Examiner*—Michael S Brooke
(74) *Attorney, Agent, or Firm*—Fitzpatrick, Cella, Harper & Scinto

(57) ABSTRACT

The present invention provides a liquid-ejecting head, a method of ejecting liquid, and a liquid-ejecting printing apparatus, which permit an image-printing with the high quality by stabilizing volumes, flying velocities, and deposition points of ejected liquid droplets and preventing the generation of splash or mist of the liquid droplets. Thus, a heater having a heating portion on the side of the liquid chamber which is broader than a heating portion of the opposite side of the liquid chamber relative to a projected point where a centroid of any cross section of the orifice in parallel with the substrate is projected on the substrate. A shape of a cross section of the orifice in parallel with the substrate which is projected on the substrate from the side of the orifice plate has a combination of two ellipse portions figures in which a centroid and a plan of the heater are coincident with each other.

16 Claims, 18 Drawing Sheets

| CASE No. | LENGTH "Ly" OF HEATER IN y DIRECTION [μm] | COORDINATE VALUE "ya" OF POINT "A" [μm] | AREA RATIO S2/S1 | PRINT QUALITY |
|---|---|---|---|---|
| 6 | 33.0 | 1.50 | 1.2 | × |
| 7 | 34.5 | 2.25 | 1.3 | △ |
| 1 | 36.0 | 3.00 | 1.4 | ○ |
| 2 | 37.5 | 3.75 | 1.5 | ○ |
| 3 | 39.0 | 4.50 | 1.6 | ○ |
| 4 | 40.5 | 5.25 | 1.7 | ○ |
| 5 | 42.0 | 6.00 | 1.8 | ○ |

FIG.17

| CASE No. | COORDINATE VALUE "yb" OF POINT "B"[μm] | AREA RATIO S2/S1 | PRINT QUALITY |
|---|---|---|---|
| 12 | 1.5 | 1.222 | × |
| 10 | 3.0 | 1.500 | ○ |
| 11 | 4.5 | 1.857 | ○ |
| 13 | 6.0 | 2.333 | △ |
| 14 | 7.5 | 3.000 | × |

FIG.18

| CASE No. | L1[μm] | L2[μm] | L2/L1 | PRINT QUALITY |
|---|---|---|---|---|
| 5 | 12.0 | 21.0 | 1.75 | △ |
| 1 | 13.0 | 21.0 | 1.61 | ○ |
| 2 | 14.0 | 21.0 | 1.50 | ○ |
| 3 | 15.0 | 21.0 | 1.40 | ○ |
| 4 | 16.0 | 21.0 | 1.31 | × |

FIG.21

| CASE No. | L1[μm] | L2[μm] | L2/L1 | PRINT QUALITY |
|---|---|---|---|---|
| 10 | 21 | 29.0 | 1.38 | × |
| 6 | 21 | 30.0 | 1.43 | ○ |
| 7 | 21 | 31.0 | 1.48 | ○ |
| 8 | 21 | 32.0 | 1.52 | ○ |
| 9 | 21 | 33.0 | 1.57 | ○ |

FIG.22

| CASE No. | L1[μm] | L2[μm] | L2/L1 | PRINT QUALITY |
|---|---|---|---|---|
| 11 | 14.0 | 28.0 | 2.00 | ○ |
| 12 | 10.0 | 30.0 | 3.00 | △ |

FIG.23

LIQUID-EJECTING HEAD, LIQUID-EJECTING METHOD AND LIQUID-EJECTING PRINTING APPARATUS

This application is based on Japanese Patent Application No. 10-377652 (1998) filed Dec. 29, 1998 and Japanese Patent Application No. 11-120723 (1999) filed Apr. 27, 1999, the contents of which are incorporated hereinto by reference.

BACKGROUND OF THE INVENTION

1. Field of the Invention

The present invention relates to a liquid-ejecting head and a method of ejecting a liquid using such a liquid-ejecting head. The present invention also relates to a liquid-ejecting type printing apparatus using such a liquid-ejecting head or such a method.

2. Description of the Related Art

A liquid-ejecting printing method, which is of forming an image by depositing an ejected liquid on a printing medium using a thermal energy, allows a printing operation at high resolution and high speed with a low noise level and provides a high printing quality. In addition, such a method has advantages that it can be easily applied on a multi-color printing and also it is able to print any information on a piece of ordinary paper.

The liquid-ejecting printing method is disclosed, for example in Japanese Patent Application Laying-open No. 4-10941 (1992) that suggests the process for releasing a bubble into the atmosphere under the condition that the primary product of differentiating a velocity of the bubble that moves on the tip in the direction of eject is defined takes on a negative value. In this case, the work done by the bubble relative to the electric energy applied on a thermal resistor element (which is responsible for generating a thermal energy for ejecting ink from an orifice) is more excellent than that of the former liquid-ejecting head because of the short distance between the thermal resistor element and the orifice. In addition, there is another advantage of stabilizing the volumes of the ejected liquid droplets because the whole volume of the liquid existed between the thermal resistor element and thee orifice can be substantially ejected.

However, the above conventional method includes the following problems to be solved.

It is very difficult to perfectly prevent the generation of splash or mist of the liquid droplet even though the following fact. That is, there is an advantage of substantially preventing the deterioration of printing quality as a result of reducing the generation of splash or mist of the liquid droplet by releasing a bubble into the atmosphere under the condition that the primary product of differentiating a velocity of the bubble that moves on the tip in the direction of ejecting is defined takes on a negative value.

It is also difficult to maintain the printing quality at high level if the following fact is occurred. In the conventional liquid-ejecting method, there is a possibility that a bubble may communicate with the atmosphere through the portion in the vicinity of the orifice on the liquid chamber's side at first because of the momentary formation of a liquid column at a central portion of the orifice at the time of ejecting the liquid droplet. In this case, the posterior portion of the liquid column hear the above communicating portion may fall on a substrate. On the other hand, a liquid membrane is formed between the remaining posterior portion of the liquid column and the orifice, so that the remaining posterior portion of the liquid column is kept from a drop on the substrate by such a membrane. Consequently, the tail end of the liquid column may falls on the substrate with a deviation from the center of the orifice, resulting in a deleterious effect on the direction along which the liquid droplet flies in straight. Furthermore, it may affect on the accuracy of placing the liquid droplet in the right place In this case, therefore, it is difficult to maintain the printing quality at high level.

For the liquid-ejecting method, one of very important problems is the efforts on further improvement of the image quality by preventing the generation of splash or mist of the liquid droplet to the limit. And other one of very important problems is how to keeping the printing quality at high level by improvement on the accuracy of placing the ink droplet in the right place.

SUMMARY OF THE INVENTION

The present invention is implemented to solve the foregoing problems. It is therefore an object of the present invention is to provide a liquid-ejecting head, a method of ejecting a liquid droplet, and a liquid-ejecting printing apparatus that allow the high quality of printing by substantially stabilizing the properties of ejected ink droplets, such as their volumes and flying velocities and their correct positioning, without the generation of splash or mist thereof.

In the first aspect of the present invention, there is provided a liquid-ejecting head comprising:

an orifice plate with an orifice for ejecting liquid;

a substrate provided substantially in parallel to the orifice plate and having energy-generating means for generating thermal energy to be used for generating a bubble to eject liquid from the orifice, a liquid-flowing path formed between the orifice plate and the substrate and communicated with the orifice so as to supply liquid from a liquid chamber to the orifice, wherein the energy-generating means generates the bubble for forming a flow of liquid that directs to the liquid chamber and a flow of liquid that directs to the orifice in a flow area shifted to a side of the liquid chamber so that an amount of liquid directing to the orifice becomes substantially uniform around an inner peripheral surface of the orifice at a time of ejecting liquid.

Here, a method of ejecting liquid by using the liquid-ejecting head of the first aspect, may comprise the steps of:

deforming a part of the interface between liquid and the bubble formed in liquid so that the interface contacts to the substrate; and communicating the bubble with an atmosphere after the step of deforming the interface.

A liquid-ejecting printing apparatus for printing, an image on a printing medium by using the liquid-ejecting head of the first aspect, may comprise:

means for moving the liquid-ejecting head and the printing medium relatively to each other; and means for supplying a driving signal to the liquid-ejecting head.

In the second aspect of the present invention, there is provided a liquid-ejecting head comprising:

an orifice plate with an orifice for ejecting liquid;

a substrate provided substantially in parallel to the orifice plate and having energy-generating means for generating thermal energy to be used for generating a bubble to eject liquid from the orifice, a liquid-flowing path formed between the orifice plate and the substrate and communicated with the orifice so as to supply liquid from a liquid chamber to the orifice, wherein the energy-generating means generates the bubble for forming a flow of liquid that directs to the liquid chamber and a flow of liquid that directs to the orifice in a flow area shifted to a side of the liquid chamber so that a thickness of a liquid membrane is uniformly formed along an inner peripheral surface of the orifice at the time of ejecting the liquid.

Here, a method of ejecting liquid by using the liquid-ejecting head of the second aspect, may comprise the steps of:

deforming a part of the interface between liquid and the bubble formed in liquid so that the interface contacts to the substrate; and communicating the bubble with an atmosphere after the step of deforming the interface.

A liquid-ejecting printing apparatus for printing an image on a printing medium by using the liquid-ejecting head of the second aspect, may comprise:

means for moving the liquid-ejecting head and the printing medium relatively to each other; and means for supplying a driving signal to the liquid-ejecting head.

In the third aspect of the present invention, there is provided a liquid-ejecting head comprising:

an orifice plate with an orifice for ejecting liquid;

a substrate provided substantially in parallel to the orifice plate and having energy-generating means for generating thermal energy to be used for generating a bubble to eject liquid from the orifice, a liquid-flowing path formed between the orifice plate and the substrate and communicated with the orifice so as to supply liquid from a liquid chamber to the orifice, wherein a shape of a cross section of the orifice in parallel with the substrate which is projected on the substrate from a side of the orifice plate is composed of a partial combination of a plurality of figures and a centroid of the cross section and a centroid of the energy-generating means are coincident with each other.

Here, a method of ejecting liquid by using the liquid ejecting head of the third aspect, may comprise the steps of:

deforming a part of the interface between liquid and the bubble formed in liquid so that the interface contacts to the substrate; and communicating the bubble with an atmosphere after the step of deforming the interface.

A method of ejecting liquid by using the liquid-ejecting head of the third aspect, may comprise the step of:

generating a bubble using the energy-generating means that generates the bubble for forming a flow of liquid that directs to the orifice so that a thickness of a liquid membrane is uniformly formed along an inner peripheral portion of the orifice at the time of ejecting the liquid.

A liquid-ejecting printing apparatus for printing an image on a printing medium by using the liquid-ejecting head of the third aspect, may comprise:

means for moving the liquid-ejecting head and the printing medium relatively to each other; and means-for supplying a driving signal to the liquid-ejecting head.

In the fourth aspect of the present invention, there is provided a liquid-ejecting head comprising:

an orifice plate with an orifice for ejecting liquid;

a substrate provided substantially in parallel to the orifice plate and having energy-generating means for generating thermal energy to be used for generating a bubble to eject liquid from the orifice, a liquid-flowing path formed between the orifice plate and the substrate and communicated with the orifice so as to; supply liquid from a liquid chamber to the orifice, wherein a contour of a cross section of the orifice in parallel with the substrate which is projected on the substrate from a side of the orifice plate is composed of a partial combination of contours of a plurality of figures and a centroid of the cross section and a centroid of the energy-generating means are coincident with each other.

Here, a method of ejecting liquid by using the liquid-ejecting head of the fourth aspect, may comprise the steps of:

deforming a part of the interface between liquid and the bubble formed in liquid so that the interface contacts to the substrate; and communicating the bubble with an atmosphere after the step of deforming the interface.

A method of ejecting liquid by using the liquid-ejecting head of the fourth aspect, may comprise the step of:

generating a bubble using the energy-generating means that generates the bubble for forming a flow of liquid that directs to the orifice so that a thickness of a liquid membrane is uniformly formed along an inner peripheral portion of the orifice at the time of ejecting the liquid.

A liquid-ejecting printing apparatus for printing an image on a printing medium by using the liquid-ejecting head of the fourth aspect, may comprise:

means for moving the liquid-ejecting head and the printing medium relatively to each other; and means for supplying a driving signal to the liquid-ejecting head.

According to the present invention, therefore, the following items (1) and (2) can be successively attained with stability.

(1) Under the condition that a bubble and the atmosphere are not communicated with each other, a posterior end of liquid column as a part of the interface between the bubble and the liquid comes into contact with a substrate that forms a part of a liquid-flowing path without causing any deviation from a central axis of an orifice. Thus, the property of keeping the liquid column as a straight line and the property of keeping the direction along which a liquid droplet flies in straight are attained.

(2) After the contact between the posterior end of the liquid column and the substrate, the air babble communicates with the atmosphere at a portion of the inner side of the orifice in the vicinity of the substrate. Thus, the release of splash or mist of the liquid to the outside of the liquid-flowing path can be prevented. In addition, a cavitation damage can be also prevented.

By successively satisfying the above items (1) and (2), the deterioration of an image quality of the printed image caused by unstable satellite can be prevented. Because, the properties of ejected liquid droplets, such as their volumes and flying velocities and also the behavior of the tail end of the liquid droplet at the time of running out of the liquid are substantially stabilized. Furthermore, the high quality image can be allowed as a result of preventing the generation of mist by performing the communication between the bubble and the atmosphere in the liquid-flowing path.

Some of the current-used methods for manufacturing the conventional liquid-ejecting heads may be applicable to a liquid-ejecting head of the present invention. Using the liquid-ejecting head of the present invention, a novel method for ejecting a liquid can be realized. The novel method comprises the steps of deforming a part of the interface between a liquid and a bubble formed in the liquid; land communicating the bubble with the atmosphere. According to the present invention, furthermore, there is no need to increase the number of manufacturing steps in the novel method, so that the effective cost for production can be attained.

Accordingly, the present invention allows the stable eject of liquid droplets by stabilizing the conditions of ejecting liquid droplets and also stabilizing the behavior of the tail end of the liquid droplet at the time of running out of the liquid. If an image is formed using such liquid droplets, the deterioration of image quality of the printed image caused by unstable satellite can be prevented. In addition, the printing of image at high quality can be allowed as a result of preventing the generation of mist by performing the communication between the bubble and the atmosphere in the liquid-flowing path.

In the present invention, furthermore, there is no step of the collapse of a bubble, so that we can prevent any damage on a means of generating energies, such as a heater, by cavitation (i.e., the sudden formation and collapse of air bubbles in the liquid). Accordingly, the longevity of the liquid-ejecting head can be increased.

Furthermore, some of the currently-used methods for manufacturing the conventional liquid-ejecting heads may be applicable to a liquid-ejecting head of the present invention, so that there is no need to increase the number of manufacturing steps in the novel method and thus the effective cost for production can be attained.

BRIEF DESCRIPTION OF THE DRAWINGS

FIG. 17 is a table for illustrating the results of observing the availability of the liquid-ejecting head as the first embodiment of the present invention;

FIG. 18 is a table for illustrating the results of observing the availability of the liquid-ejecting head as the second embodiment of the present invention;

FIG. 21 is a table for illustrating the effectiveness of a liquid-ejecting head of a third embodiment in accordance with the present invention;

FIG. 22 is a table for illustrating the effectiveness of a liquid-ejecting head of a fourth embodiment in accordance with the present invention; and FIG. 23 is a table for illustrating the effectiveness of a liquid-ejecting head of a fifth embodiment in accordance with the present invention.

DETAILED DESCRIPTION OF THE PREFERRED EMBODIMENT

Figure 1:
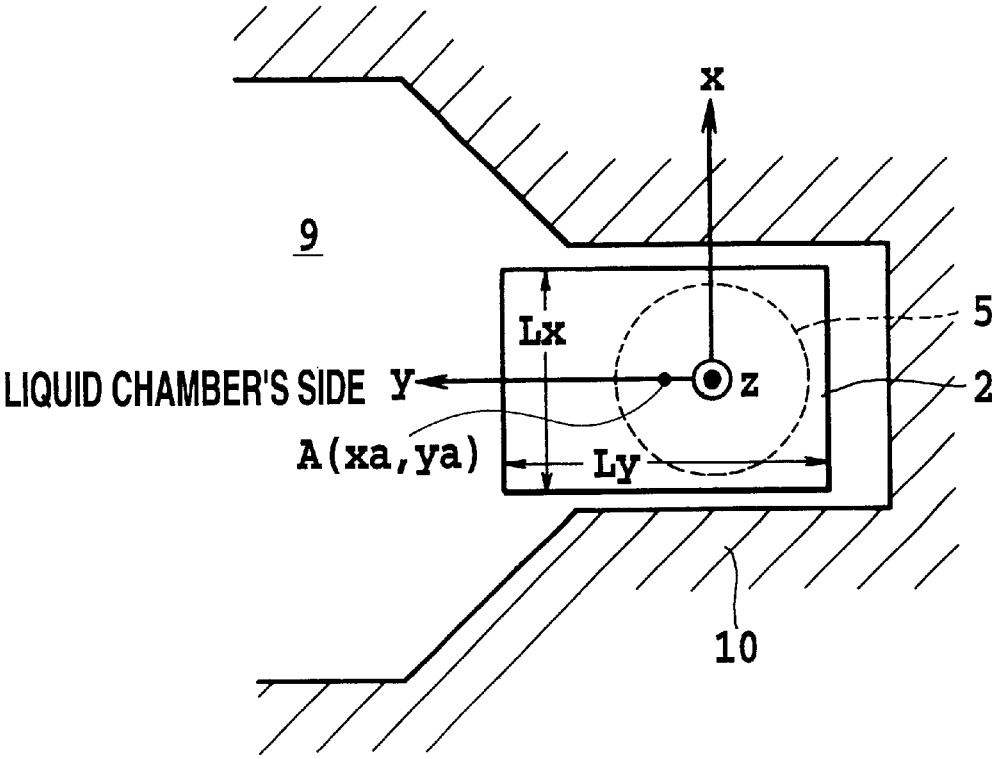
FIG. 1 is a cross sectional view of the major part of an ink-ejecting head of a first preferred embodiment in accordance with the present invention.

Hereinafter we will explain preferred embodiments of the present invention with reference to the attached drawings.

Liquid-ejecting Method

FIGS. 5A to 5G are schematic cross sectional views for explaining the sequential changes in the behavior of liquid-eject by a liquid-ejecting head in accordance with the liquid-ejecting method of the present invention.

In those figures, the reference numeral 1 denotes a silicon (Si) substrate on which a plurality of heaters 2 is formed as energy-generating means. At a position facing to the top surface of the heater 2, there is an orifice 5 for ejecting a liquid droplet. The orifice 5 is formed on an orifice plate 4 being located at a location some distance from an end wall 10 of an ink-flowing path 9. In addition, the ink-flowing path 9 is formed in the assembly consisting of the orifice plate 4, the substrate 1, and the ink-passage's walls. The ink-flowing path 9 is filed with link 3 as a liquid provided from an ink chamber (not shown) on the left side of each of FIGS. 5A to 5G as necessary. Meniscus is formed on an opening of the orifice 5. Furthermore, the reference numeral 6 denotes a bubble generated in the ink quickly heated by the heater 2. The reference numeral 8 denotes an ink column protruded from the orifice 5 by receiving pressure from the bubble 6, and 7 denotes an ink droplet ejected from the orifice 5 by receiving pressure from the bubble 6.

Figure 5A:
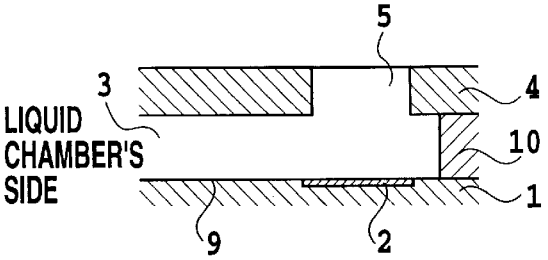
FIGS. 5A, 5B, 5C, 5D, 5E, 5F, and 5G are cross sectional views of the major part of a liquid-ejecting head for respectively illustrating the continuous actions of liquid-eject as the respective steps in the liquid-ejecting method in accordance with the present invention.
Figure 5B:
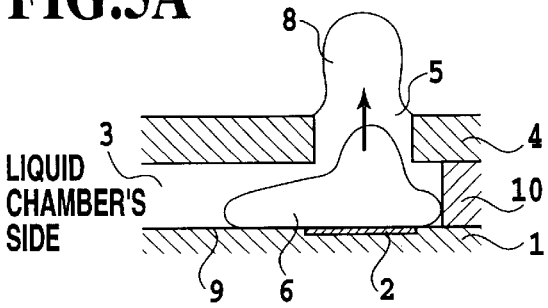
Figure 5C:
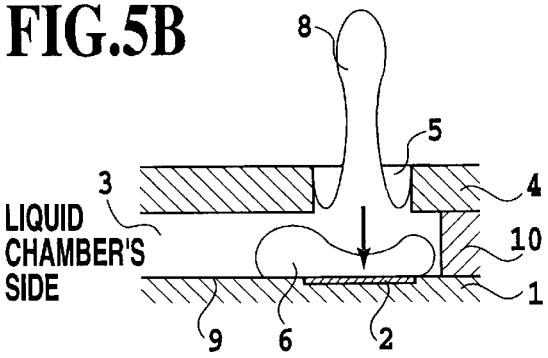
Figure 5D:
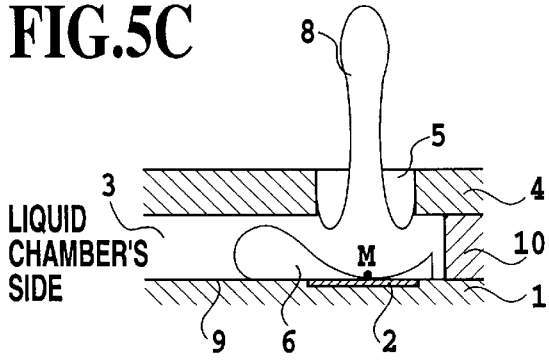

Referring now to FIG. 5A, there is shown an initial condition of the liquid-eject in which the ink-flowing path 9 is filled with ink 3. As shown in FIG. 5B, the heater 2 is switched on by receiving an electric signal and simultaneously begins to heat ink 3 around the heater 2, quickly, causing a bubble 6 in ink 3 around the heater 2. An ink column grows and protrudes from the orifice 5 by changing the volume of the bubble 6. Subsequently, as shown in FIG. 5C, the bubble undergoes a sudden change, i.e., it begins to shrink by bring physical factors into a condition of equilibrium, where the factors includes the volume of a portion of the ink column 8 which outwardly protruded from the orifice 5, an inner pressure of the bubble, 6, and the atmospheric pressure. As shown in FIG. 5D, there is an interface between the bubble 6 and ink 3 and a tart of such an interface corresponds to a portion "M" of the posterior end of the ink column 8. The portion "M" makes contact with the heater 2.

Therefore, the first point of the present invention is to realize the phenomenon showing in FIG. 5D with stability. If it is not realized, the following phenomenon may be observed.

Figure 6A:
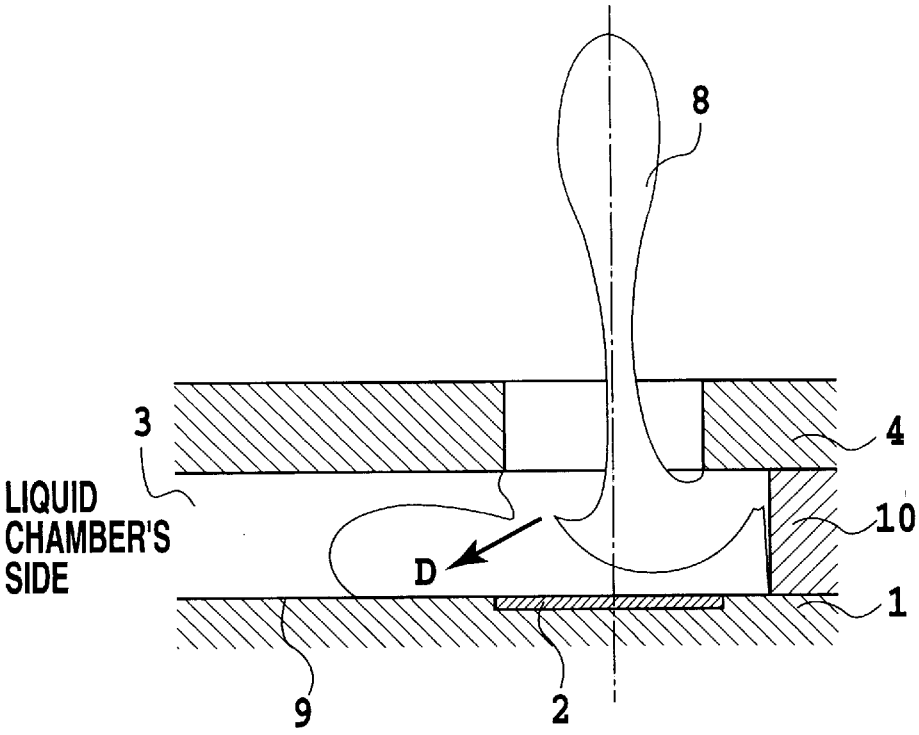
FIGS. 6A and 6B are cross sectional views of the major part of a liquid-ejecting head for respectively illustrating the condition in which a bubble communicates with the atmosphere unevenly.
Figure 6B:
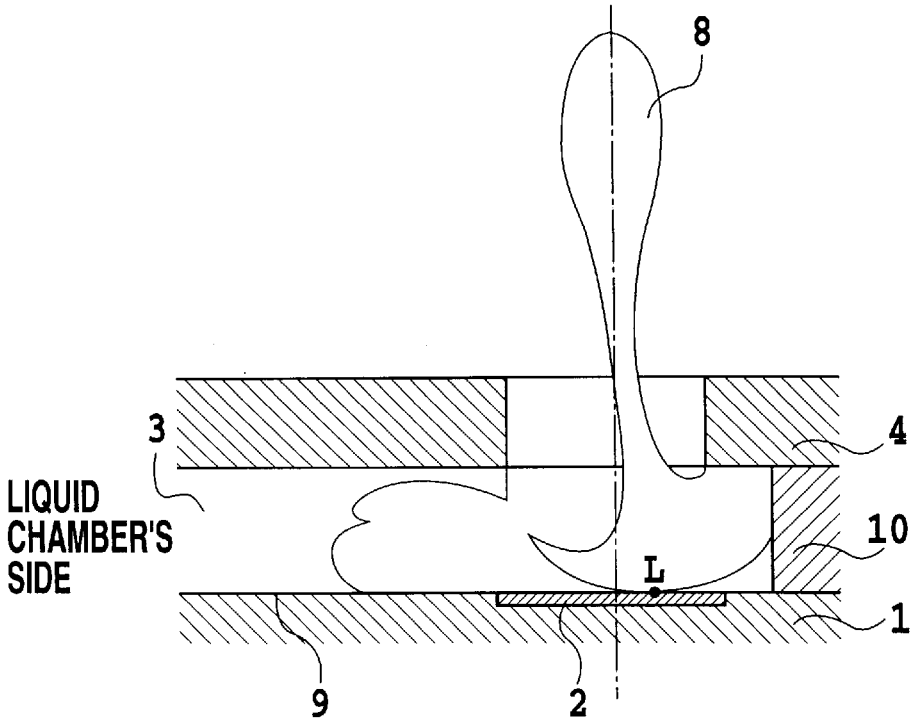
Figure 9:
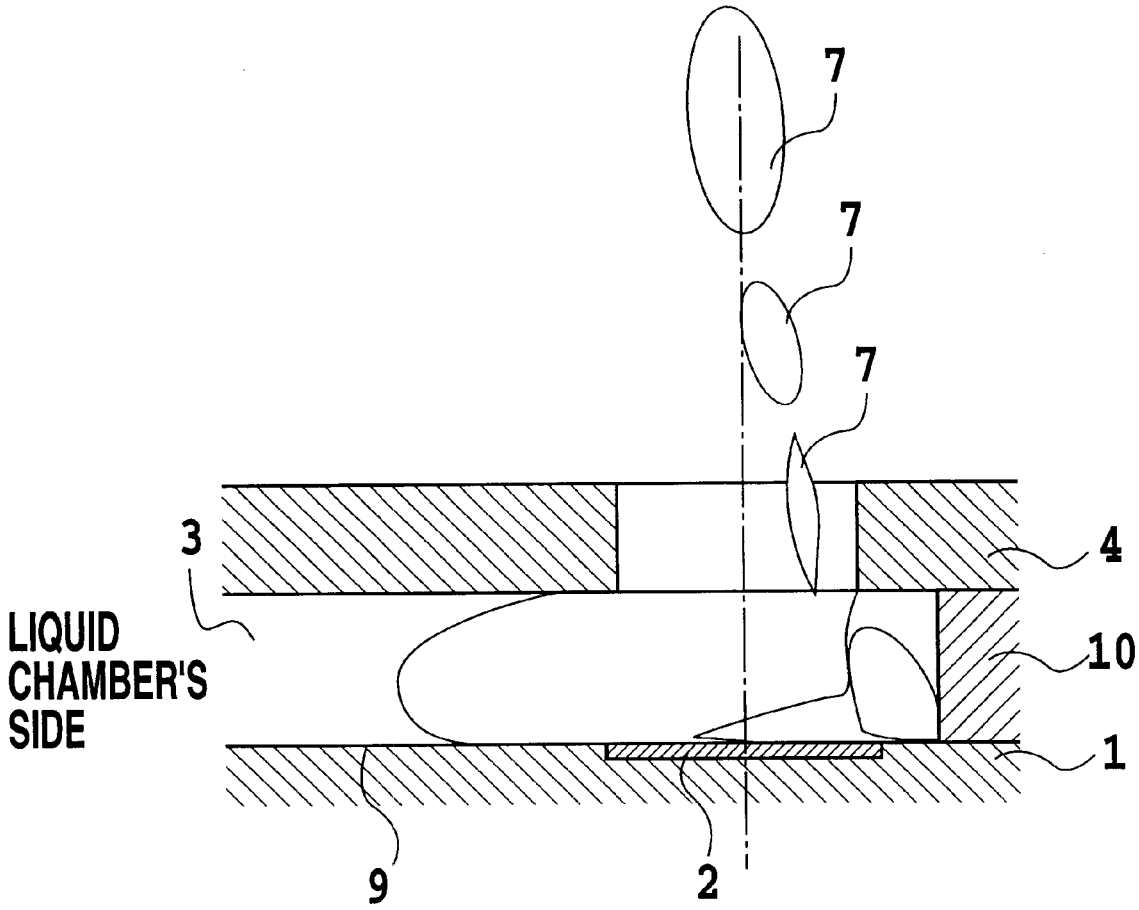
FIG. 9 is a cross sectional view of the major part of a liquid-ejecting head for illustrating the condition in which the path of a liquid droplet deviates from a predetermined straight line.

As shown in FIG. 6A, if the bubble 6 bursts in the direction of the arrow D and concurrently communicates with the atmosphere before the posterior end of the ink column 8 makes contact with the heater 2, the posterior end of the ink column 8 may contact with the heater 2 at the point "L" (see FIG. 6B) deviated toward the opposite direction of the liquid chamber (i.e., toward the right side of the figure). As a result, as shown in FIG. 9 and FIG. 10, the direction of protruding the ink column 8 and the eject of an ink droplet 7 tend to deviate from the direction perpendicular to the orifice plate 4.

A uniform communication of the bubble 6 with the atmosphere as shown in FIG. 6A can be caused by the following reasons.

Figure 14A:
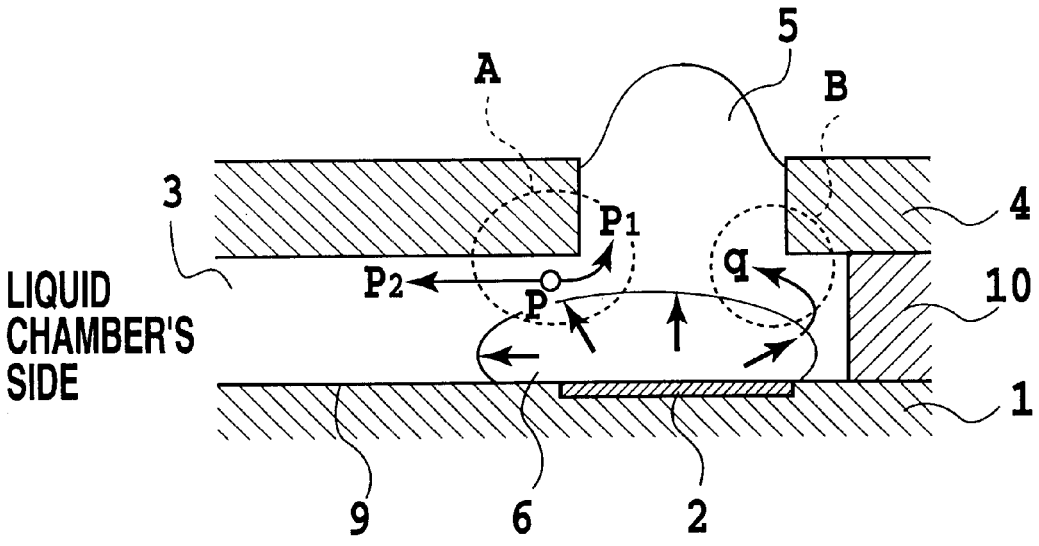
FIGS. 14A and 14B are cross sectional views of the major part of the liquid-ejecting head for respectively illustrating the-reasons of generating the non-uniform communication of a bubble with the atmosphere.
Figure 14B:
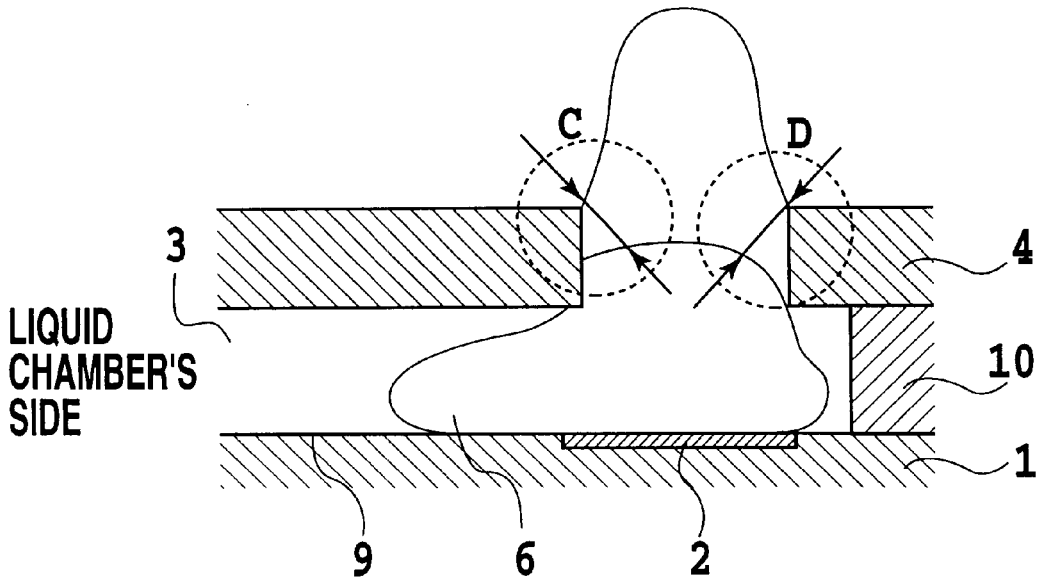

First of all, in FIG. 14A, the flows of ink in the regions surrounded by broken lines "A" and "B" are compared, respectively. In the region "B", the ink 3 flows in the direction of the arrow "q" as a bubble 6 grows. The flow of the ink 3 pushes up the ink 3 around the wall 10 of the ink-flowing path directs toward the orifice 5. In the area "A", on the other hand, the ink flows in two different directions of the arrow "P1" headed for the orifice 5 and the arrow "P2" headed for the liquid chamber as air bubble 6 grows. Furthermore, the letter "P" indicates a branch point (i.e., stagnant point) of the different flows in the region "A". The position of the branch point "P" may be determined by the physical and chemical factors including the manner in which the bubble grows, dimensions of each part of the liquid-ejecting head, and the physical properties of the ink 3. Observing from the liquid chamber's side, the quantity of flow toward the orifice 5 in the direction of the arrow "P1" decreases as the branch point "P" shifts its position toward the orifice 5. Thus, the amount of ink in the region "A" also decreases as the quantity of flow decreases. As shown in FIG. 14B, a thickness of ink membrane corresponding to the region surrounded by a dashed line "C" is smaller than a thickness of ink membrane corresponding to the region surrounded by dashed line "D". Therefore, the region "C" can be easily, communicated with the atmosphere before the region "D" becomes to communicate with the atmosphere, resulting in a uniform communication between the bubble and the atmosphere as shown in FIG. 6A.

Figure 5E:
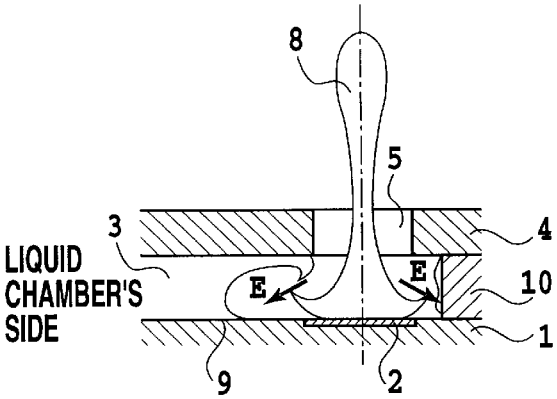

Referring now to FIG. 5E, the tip of the ink column 8 continues to protrude outwardly so as to be ejected from the orifice 5 in spite of after the contact between the heater 2 and the posterior end of the ink column 8 corresponding to a part of the interface between the ink 3 and the bubble 6. In consideration of such a fact, the second point of the present invention is to realize the communication between the bubble 6 and the atmosphere by bursting the bubble 6 within several microseconds, preferably within the range of 0.5 to 1.0 microseconds after contacting the heater 2 with the posterior end of ink 8.

If the bubble 6 remains in intact for a while after contacting the heater 2 with the posterior end of the ink column 8, the following troubles (1) and (2) may be caused.

Figure 7:
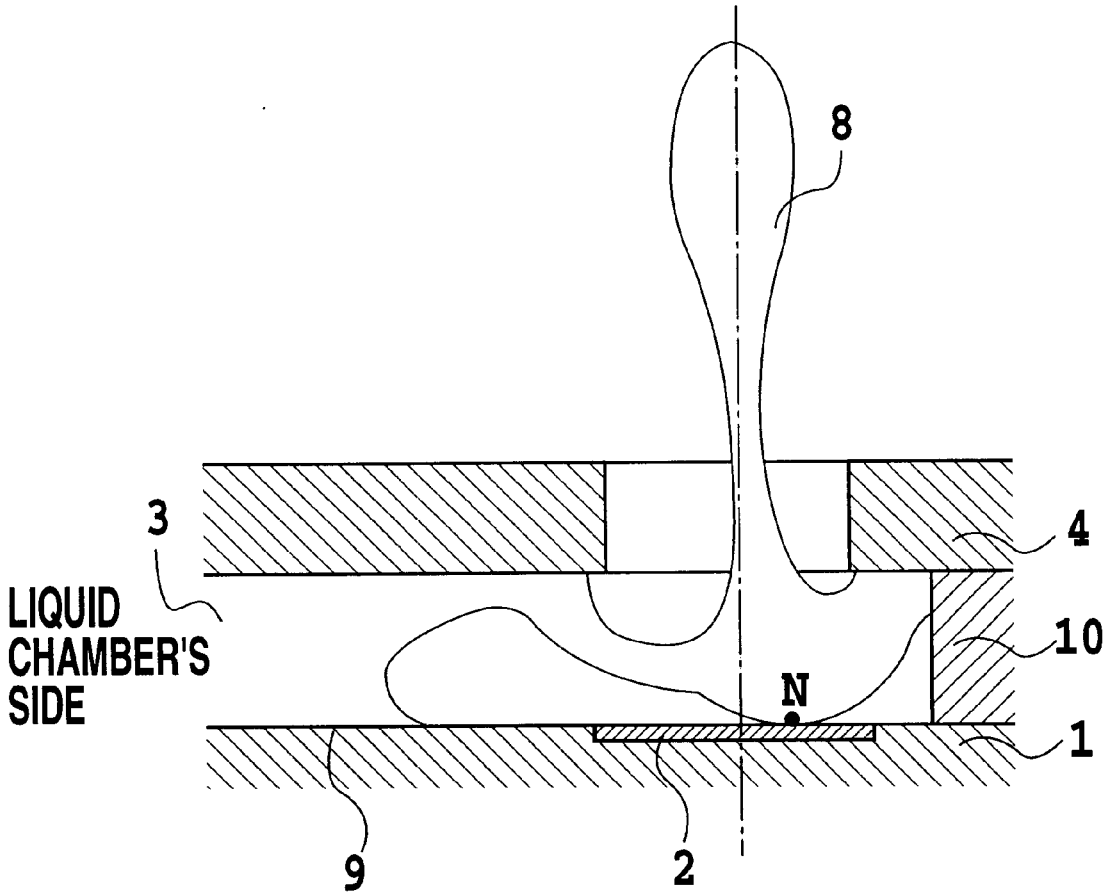
FIG. 7 is a cross sectional view of the major part of a liquid-ejecting head for illustrating the condition in which the contacting position of the posterior end of a liquid column is deviated from the right position.
Figure 8:
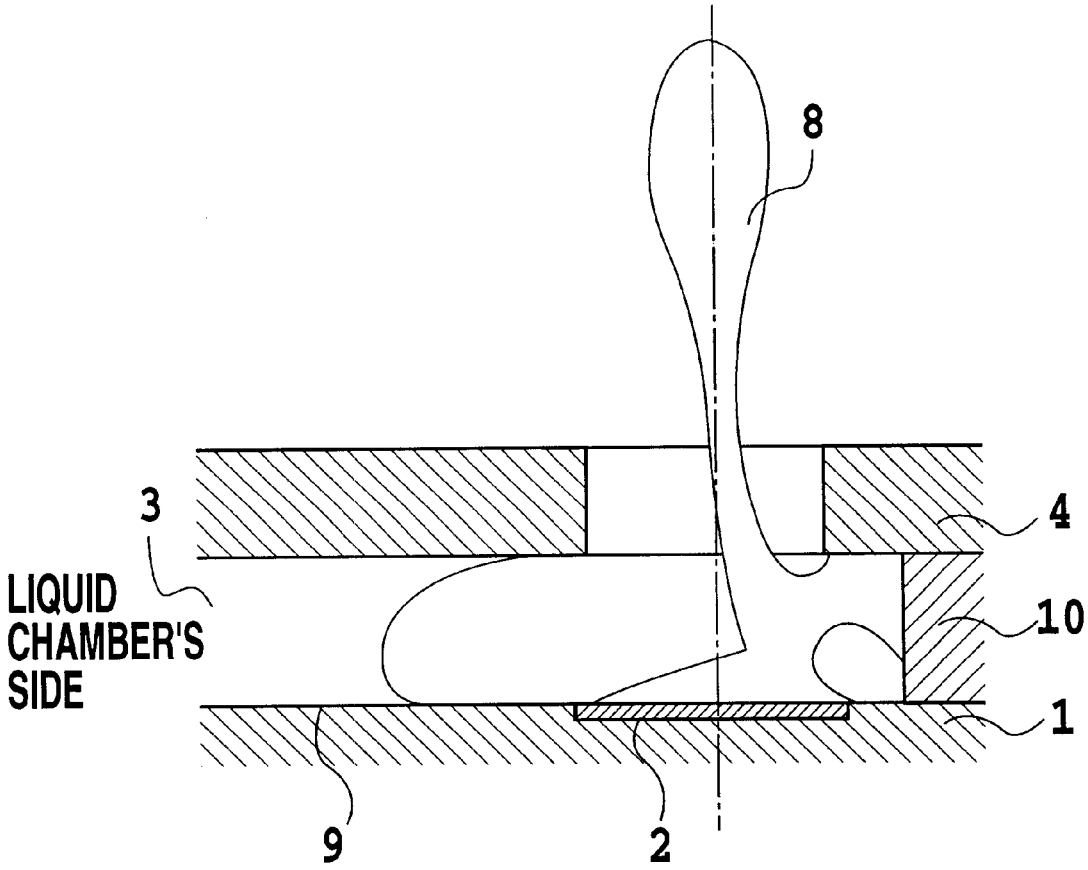
FIG. 8 is a cross sectional view of the major part of a liquid-ejecting head for illustrating the condition in which the liquid column losses its straight-line shape.

(1) The behavior of a bubble 6 forces the contact point "M" (see FIG. 5D) of the posterior end of the ink column 8 (which is an interface between the bubble 6 and the heater 3) to shift its position to another contact point "N" shown in FIG. 7, and subsequently the bubble 6 becomes to communicate with the atmosphere. As a result, as shown in FIGS. 8 and 9, the direction of protruding the ink column 8 and ejecting an ink droplet 7 tends to deviate from the direction perpendicular to the orifice plate 4.

(2) When the bubble existed for a while is disappeared, the interior of the ink-flowing path 9, especially the heater 2 is damaged by a cavitation phenomenon. As a result, the liquid-ejecting head will be short its useful life.

The above troubles (1) and (2) can be resolved by determining the timing of communicating the bubble 6 with the atmosphere by the way of the second point of the present invention described above. In the present invention, the bubble 6 bursts in the direction opposite to the orifice 5 as the arrow "E" because of the reasons that: the burst of the bubble 6 is initiated at the position far from the orifice 5 and in the interior of the ink-flow path 9; and the posterior end of the ink column 8 makes substantial contact with the inside of the ink-flowing path 9. Therefore, splash or mist of the ink 3 to be generated at the time of bursting the bubble 6 does not bust out of the orifice 5, so that the printing quality cannot be deteriorated.

Figure 5F:
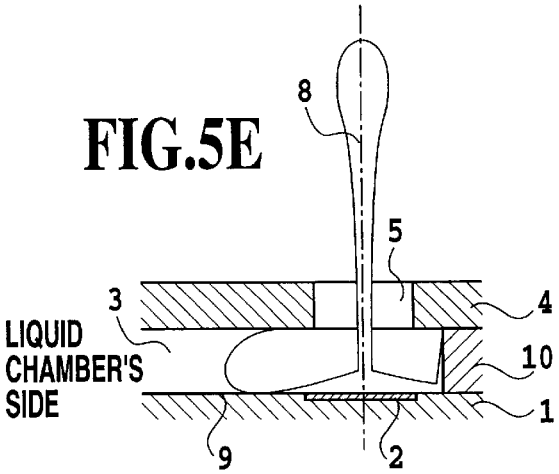
Figure 5G:
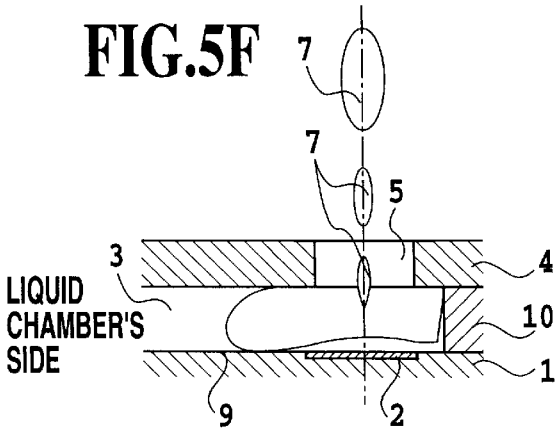

Referring now to FIG. 5F, the ink column 8 keeps its ejecting direction perpendicular to the orifice plate 4 and continues to protrude outwardly so as to be ejected from n the orifice 5. Subsequently, the ink column 8 becomes a number of flying ink droplets as shown in FIG. 5G, and finally these ink droplets are placed on a printing medium (not shown) to print an image. After that, the ink-flowing path 9 is refilled with additional ink 3 to become the initial condition of FIG. 5A in preparation for the subsequent ink eject.

Figure 12C:
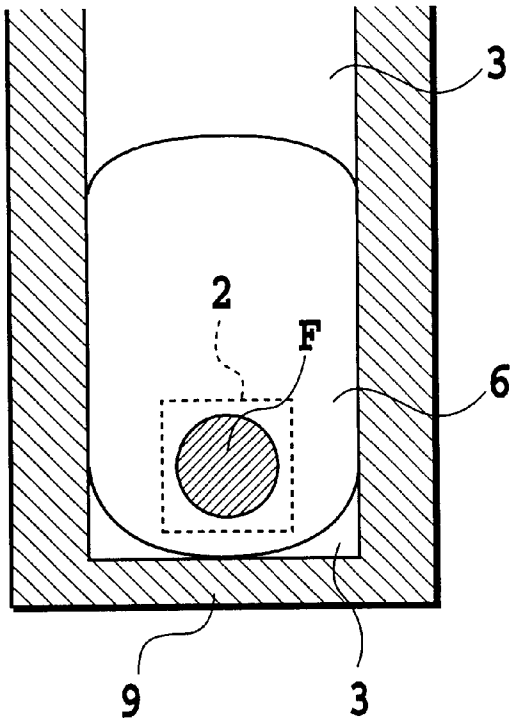
FIGS. 12A, 12B, and 12C are plane vies of the major part of the liquid-ejecting head, respectively, for illustrating the method of observing the contact position of a liquid column.
Figure 12B:
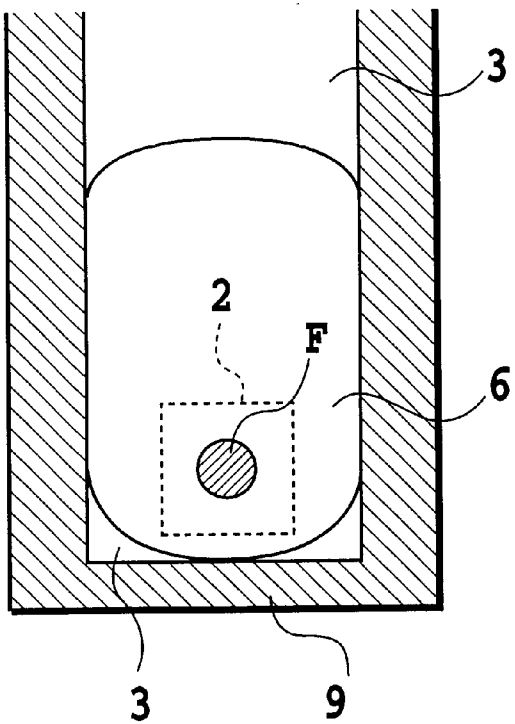
Figure 12A:
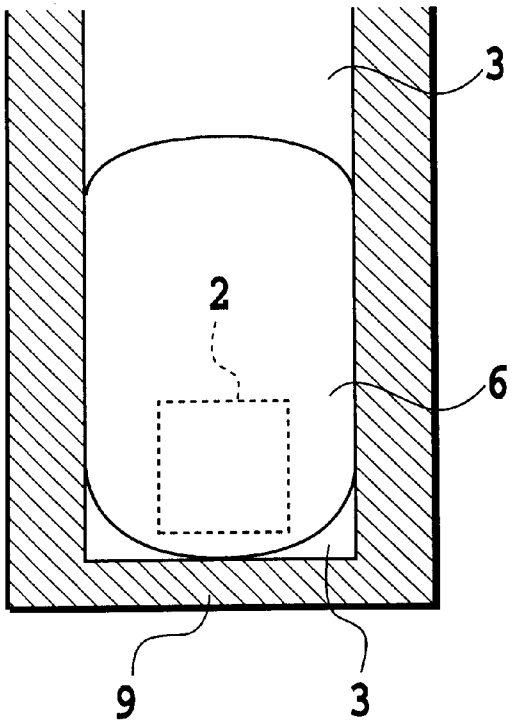

FIGS. 12A to 12C are provided for explaining the measurements of the position where the posterior end of the ink column 8 begins to make contact with the hater 2 and the time of initiating such a contact. These figures are also provided for explaining the measurements of the burst of the bubble 6 and the time of initiating such a burst. In the present embodiment, these measurements are carried out by observations of optical pulses by means of a microscope or the like. The optical pulses may be emitted from electronic flash, light-emitting diode (LED), laser, or the like from the side of orifice plate 4 of the liquid-ejecting head or the lateral side thereof.

For making the evaluations of the position where the posterior end of the ink column 8 begins to make contact with the hater 2 and the time of initiating such a contact, as shown in FIG. 12A, the focus of the microscope is adjusted on the heater 2 in advance of forming a bubble. Then, the embodiment can evaluate them by keeping on observing under the microscope during the process of forming the bubble. In FIG. 12B and 12C, the embodiment can recognize that the ink column 8 is in almost circular in cross section when the ink column 8 is beginning to contact with a surface of the heater 2 on which the microscope is being focused. The time of initially recognizing such a cross section of the ink column 8 can be evaluated as the time of initiating the contact between the posterior end of the ink column 8 and the heater 2.

For making evaluations of the burst of air bubble 6 and the time of such a burst can be carried out using another microscope. The embodiment can evaluate them by appropriately changing the focus from the initial focused point and keeping on observing under the microscope. Constituent components of the evaluation system may be modified for the observation from the side of the liquid-ejecting head.

Exemplified General Configuration of the Liquid-ejecting Head

Figure 10A:
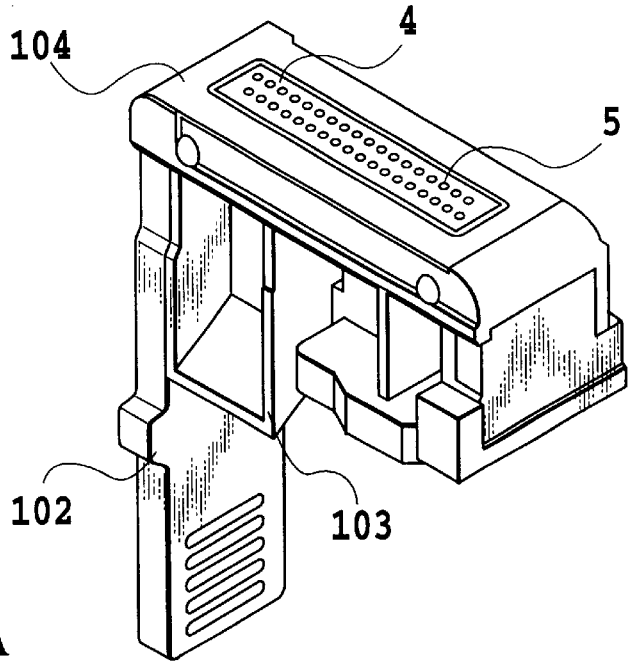
FIG. 10A is a schematic perspective view for illustrating one of the basic configurations of a liquid-ejecting head in accordance with the present invention.
Figure 10B:
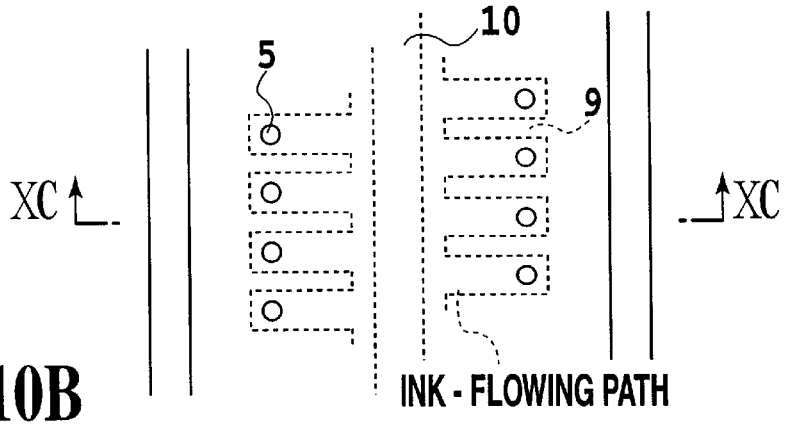
FIG. 10B is an enlarged view of the major part of the liquid-ejecting head shown in FIG. 10A.
Figure 10C:
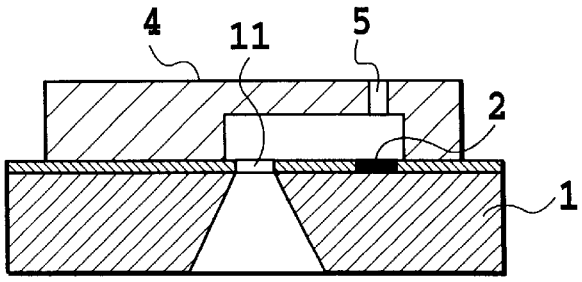
FIG. 10C is a cross sectional view of the liquid-ejecting head along the line XC—XC in FIG. 10B.

FIGS. 10A, 10B, and 10C are diagrammatic illustrations for giving a brief explanation of the overall configuration of the liquid-ejecting head. FIG. 10A is a general perspective view of an appearance of the liquid-ejecting head of the side-shooter type. FIG. 10B is a plane view that illustrates two rows of staggered ink-ejecting orifices. FIG. 10C is a cross sectional view along the line XC—XC of FIG. 10B.

In FIGS. 10A, 10B and 10C, the reference numeral 1 denotes a silicon (Si) substrate on which a plurality of heaters 2 as electro-thermal converter elements described below and a plurality of orifices 5 facing to the corresponding heaters 2 are formed by means of a thin-film technology. As shown in FIG. 10A and FIG. 10B, a plurality of the orifices 5 is arranged as two row of staggered openings on the substrate 1. In addition, the substrate 1 is bonded to a part of a L-shaped supporting member 10 by an adhesive. A wiring board 104 is fixed on the supporting member 102. A wiring portion of the wiring board 104 is electrically connected to a wiring portion of the substrate 1 by a wire bonding. The supporting member 102 may be made of aluminum in terms of cost effectiveness, processability and so on. A part of the supporting member 102 is inserted into a molding member 103, so that the latter sustains the former. The molding member 103 supplies a liquid (e.g., ink) from a liquid-storage portion (not shown) to each of orifices 5 formed on the substrate 1 through a liquid-supplying path (not shown) formed in the molding member 103. In addition, the molding member 103 acts as a placement and locating member for holding the liquid-ejecting head of the present embodiment on a liquid-ejecting apparatus described below.

A communication path (not shown) that communicates with the orifices 5 is formed as a through-hole in the substrate 1 for supplying ink passing through the liquid-supplying path of the molding member 103. The communication path acts as a common liquid chamber that communicates with the liquid-flowing paths connecting to the respective orifices 5. In the present liquid-ejecting head, as shown in FIG. 10C, an ink-supplying opening 10 is formed on the bottom of the substrate 1 by an anisotropic etching. Thus, ink is supplied from an ink tank (not shown) to all over the ink-flowing path via the ink-supplying opening 10. A heater 2 is provided substantially just under the orifice 5. The heater 2 is responsible for ejecting an ink droplet from the orifice 5 by providing a thermal energy on ink supplied from the ink-flowing path. Structural parts of the liquid-flowing path include partitions, which are formed by the known manufacturing technologies in the art such as light exposure and etching.

Fist Preferred Embodiment of the Liquid-ejecting Head

Figure 2:
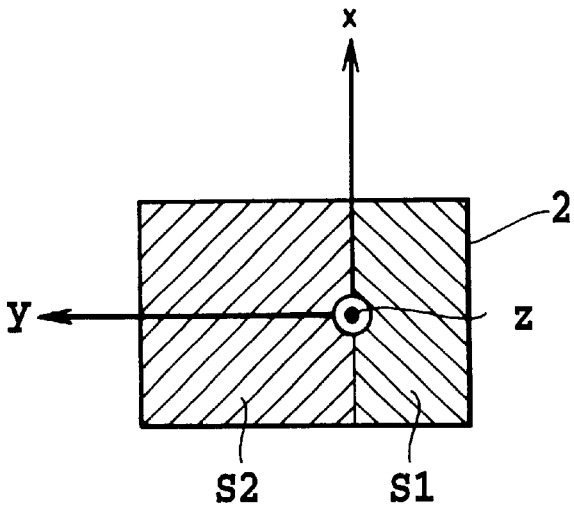
FIG. 2 is a plane view of a heater portion of the ink-ejecting head shown in FIG. 1.
Figure 3:
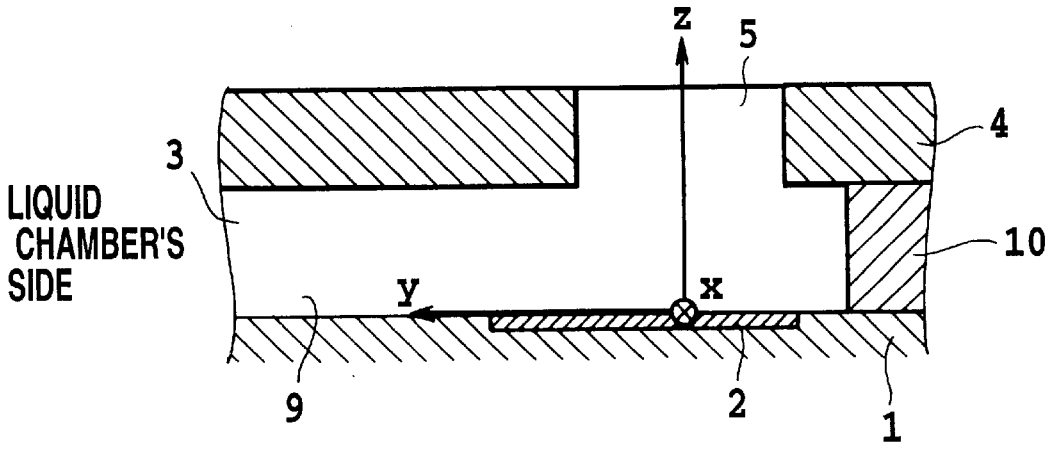
FIG. 3 is a cross sectional view of the major part of the ink-ejecting head shown in FIG. 1.

Referring now to FIGS. 1 to 3, hereinafter, a liquid-ejecting head of the first preferred embodiment of the present invention will be described in detail.

FIG. 1 is a cross sectional view of the major part of the liquid-ejecting head. In the figure, there is shown the x, y-, and z-coordinates. A centroid of any cross section of the orifice 5 in parallel with the substrate 1 is projected on the substrate 1 to obtain a projected point. The projected point is defined as an origin point of the x-, y-, and z-coordinates. The y-coordinate define's the position of point, line, or plan extending from the origin point to any point in the direction of the liquid chamber (not shown). The x-coordinate is provided as one perpendicular to the y-coordinate. The z-coordinate is in the direction of ejecting an ink droplet and provided as one perpendicular to both the x-coordinate and y-coordinate. The heater 2 of the present invention is in the shape of a rectangle with the dimensions of "Lx" in the direction along the x-coordinate (hereinafter, also referred to as the X direction) and "Ly" in the direction along the y-coordinate (hereinafter, also referred to as Y direction). The letter "A" represents a central point of the heater 2, so that it can be represented by (xa, ya) with the x- and y-coordinates.

FIG. 2 is a plane view of the heater 2 shown in FIG. 1. An area of the heater 2 located on the region of $y<0$ is represented by "S1" and an area of the heater 2 located on the region of $y \geqq 0$ is represented by "S2".

FIG. 3 is a cross sectional view along the y-z plane of the liquid-ejecting head shown in FIG. 1. The liquid-ejecting head of the present embodiment comprises an ink chamber (not shown) formed by subjecting the substrate 1 to the process of anisotropic etching. Ink 3 is supplied from the ink chamber to the orifice 5 through the ink-flowing path 9, and subsequently ejected as ink droplets from the orifice 5. A heater 2 is provided substantially just under the orifice 5. Structural parts of the ink-passage structure including the wall 10 of the ink-flowing path are formed by the known manufacturing technologies in the art, such as light exposure and etching.

In this embodiment, furthermore, the liquid-ejecting head is prepared so as to have the following properties. That is, a driving current to be applied on the heater 2 is 14.5 volts with a pulse width of 4 $\mu$sec. Ink used in the present embodiment is formulated by dissolving 4% of C.I food black 2 into an aqueous solution consisting of 80% of diethylene glycol (DEG) and 20% of water. To be more specific, a height of the ink-flowing path 9 formed on the space between the substrate 1 and the orifice plate 4 is 13.0 μm, and a thickness of the orifice plate 4 is 10.0 μm. The orifice 4 is provided as a cylindrical-shaped hole having a diameter of 21 μm. In addition, a length (Lx) of the heater 2 in the direction of X is specified with a value of 30.0 μm without any variation, and also a length (Ly) thereof in the Y direction is provided as a variable parameter. In this embodiment, therefore, seven deferent liquid-ejecting heads are prepared so as to correspond to seven different values of the parameter listed in FIG. 17, respectively. For each value of the parameter, the liquid-ejecting head thus obtained is subjected to the observations under a microscope to estimate the condition of ejecting ink droplets when the head is in operation. The obtained results are listed in FIG. 17.

In FIG. 17, a liquid-ejecting head characterized by its heater length (Ly) of 36.0 μm in the Y direction is provided as Case 1 for the observation. In this case, the point A; of the heater 2 is located at the position of ya=3.0 μm, an area ratio is S2/S1=1.4. An ejected volume of ink is about $10\times10^{-15}$ $m^3$ when the liquid-ejecting head is in operation. A velocity of ejected ink droplet is 20 m/sec. As a result of microscopic observation, the contact between the heater 2 and the posterior end of the ink column 8 (i.e., a part of the interface between the bubble 6 and the ink 3) (see FIG. 5D) is observed at 5.0 μsec after turning the power on, or 5.0 μsec after beginning of applying the driving signal to the heater 2 for driving the liquid-ejecting head. Also, the bubble 6 had burst at 5.3 μsec after turning the power on. Therefore, the above contact is occurred prior to the burst of the bubble 6. Subsequently, as a result of the successive microscopic observation on the condition in which the posterior end of the ink droplet 7 passed by the orifice 5, the ink column 8 is shaped into a straight line without any doubt. Also, the condition of the ink droplet 7 placed on the printing medium is also excellent. In spite of continuous printing operation, furthermore, an enclosure of the printing apparatus is in good condition and not filled with ink mist.

In Case Nos. 2 to 5, when the parameter "Ly" is 37.5 μm, 39.0 μm, 40.5 μm, or 42.0 μm, the same excellent condition of ink eject as that of Case No. 1 can be observed. In these examples, the accuracy of placing an ink droplet 7 on the predetermined area of the printing medium is also excellent. In spite of continuous printing operation, furthermore, an enclosure of the printing apparatus is in good condition and not filled with ink mist.

For Case No. 6, a liquid-ejecting head characterized by its heater length (Ly) of 33.0 μm in the Y direction is prepared for the observation. In this case, the point "A" (see FIG. 1) of the heater 2 is located at the position of ya 1.5 μm, an area ratio is S2/S1=1.2. An ejected volume of ink is about $10\times10^{-15}$ $m^3$ when the liquid-ejecting head is in operation. A velocity of ejected ink droplet is 20 m/sec. As a result of microscopic observation, however, the bubble 6 had burst at 4.6 μsec after turning the power on. At this time, the bubble is disappeared, so that there is no interface between the bubble 6 and the ink 3. After the burst of air bubble 6, the contact point "N" of the posterior end of the ink column 8 (but not a part 6f the interface between the bubble 6 and the ink 3) is shifted its position from the origin point to the negative side of the y-coordinate as shown in FIG. 7. Subsequently, as a result of the successive microscopic observation on the condition in which the posterior end of the ink droplet 7 passed by the orifice 5, the ink column 8 is not shaped into a straight line but shaped into a curved line as shown in FIG. 8 and FIG. 9.

For Case No. 7, a liquid-ejecting head characterized by its heater length (Ly) of 34.5 μm in the Y direction is provided for the observation. In this case, an area ratio is S2/S1=1.3. An ejected volume of ink is about $10\times10^{-15}$ $m^3$, a velocity of ejected ink droplet is 20 m/sec when the liquid-ejecting head is in operation. As a result of microscopic observation, the bubble 6 had burst at 4.9 μsec after turning the power on. The bubble 6 has burst almost concurrently with the contact between the heater 2 and the posterior end of the ink column 8. The contact point "N" of the posterior end of the ink column 8 is almost on the origin point in spite of being shifted its position slightly in the negative side of the y-coordinate. Subsequently, as a result of the successive microscopic observation on the condition in which the posterior end of the ink droplet 7 passed by the orifice 5, the ink column 8 is 'shaped substantially into a straight line. In addition, the condition of the ink droplet 7 placed on the printing medium is also acceptable. In spite of continuous printing operation, furthermore, an enclosure of the printing apparatus is in good condition and not filled with ink mist.

In the present embodiment, as described above, a length of the heater 2 in the Y direction is provided as a variable parameter and other factors are provided as fixed parameters. Ly=34.5 μm (S2/S1=1.3) stands on the boundary between the acceptable and unacceptable conditions. The acceptable condition is responsible for keeping the ink column 8 in the shape of a straight line and ejecting an ink droplet in a straight line. For attaining the excellent condition of ink eject with stability, an area ratio is preferably 1.4 or less (S2/S1>1.4). It is noted that the value of Ly (=34.5 μm) is not invariable. It is obvious that the value of Ly may be varied depending the factors including the physical properties of the liquid-ejecting head, such as dimensions, shape, and ink-eject operating condition, and the physical characteristic of ink. Therefore, it will be obvious to those skilled in the art that many modifications and variations of the above embodiment are possible to provide a more appropriate configuration thereof.

Moreover, the embodiment prepared liquid-ejecting heads with the upper limits of Ly=42.0 μm and S2/S1=1.8. That is, a utility upper limit of a length (Ly) of the heater 2 in the Y direction may be Ly 42.0 μm at which volumes and speeds of ink droplets 7 ejected from the orifice become to converge to their respective constant values on account of the following reasons. Firstly, if the liquid chamber's side of a heater has bigger dimensions more than necessary, it losses an amount of eject energy toward the liquid chamber. Thus, the heater of bigger dimensions does not contribute to improve the performance of ink eject such as a volume and a speed of ejected ink droplet. Secondary, meniscus of ink to be formed on the orifice 5 is considerably deep in the inside, so that necessary time for ink refill becomes long and printing speed becomes late. By these reason, it is not preferable to increase the dimensions of the heater 2 over than an upper limit defined as the dimensions of the heater 2 at which volumes and speeds of ink droplets 7 ejected from the orifice become to converge to their respective constant values.

In the present embodiment, the liquid chamber's side of a heater 2 has bigger dimensions but not more than required, so that the liquid-ejecting head obtains the excellent eject condition as described above because of the following reasons.

Figure 15A:
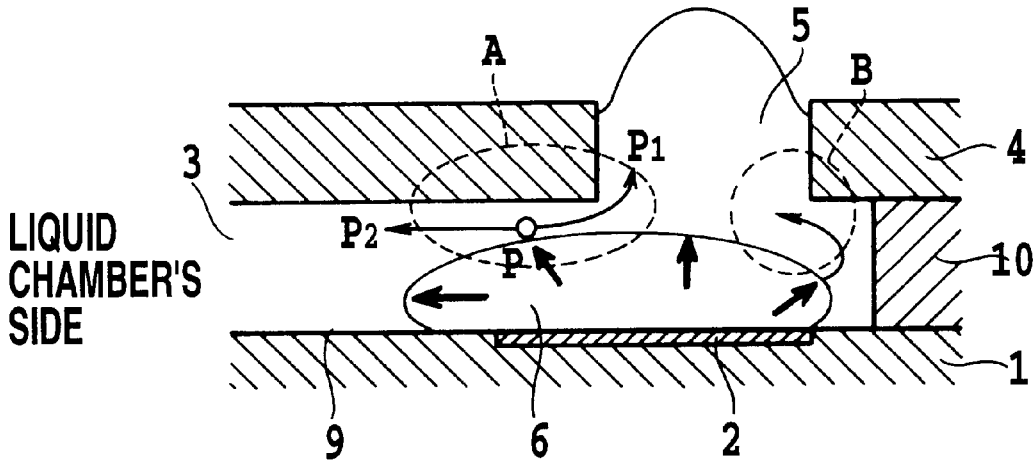
FIGS. 15A and 15B are cross sectional views of the major part of the liquid-ejecting head, respectively, for illustrating the linear property of a liquid column in a liquid-ejecting head as a first embodiment of the present invention.

As shown in FIG. 15A, the liquid chamber's side of a heater 2 has bigger dimensions, so that a bubble 6 tends to be inflated toward the liquid chamber and also the branch point "P", where the flow of ink is being stagnant, shifts its position toward the liquid chamber. Therefore, a flow rate of ink in the direction of the arrow "p1" is increased and the volume of ink to be pushed into the orifice 5 from the region "A" is increased, so that a flow rate of ink around an inner peripheral surface of the orifice 5 becomes substantially constant. As the ink eject operation proceeds, a thickness of ink membrane at the region indicated by the arrow "C" in the figure becomes almost equal to a thickness of ink membrane at the region indicated by the arrow "D" in the figure. In other words, the liquid chamber's side of a heater has bigger dimensions, so that a thickness of ink membrane at the region "C" is increased and finally a thick of ink membrane formed on an inner peripheral surface of the orifice 5 becomes uniform. Consequently, the excellent ink eject conditions as shown in FIGS. 5D, 5E, 5F and 5G can be obtained in the subsequent steps of the ink eject operation.

Second Preferred Embodiment of the Liquid-ejecting Head

Figure 4:
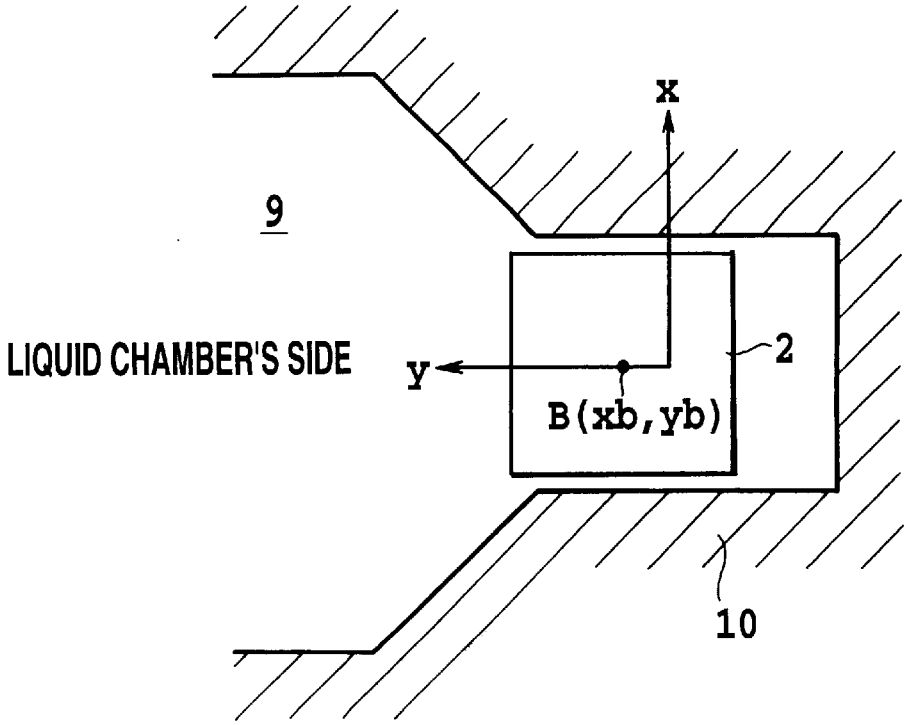
FIG. 4 is a cross sectional view of the major part of an ink-ejecting head of a second preferred embodiment in accordance with the present invention.

FIG. 4 is a cross sectional view of the liquid-ejecting head as a second preferred embodiment of the present invention.

In the present embodiment, a heater 2 is substantially in the shape of a square. In the figure, the letter "B" indicates a center point of the heater 2 and its x- and y-coordinates are represented by (xb, yb). The dimensions of the heater 2 are Lx=Ly=30 $\mu$m. The conditions except dimensions and position of the heater 2 of the present embodiment are identical as those of the first preferred embodiment. Liquid-ejecting heads are prepared so as to have the heater 2 being located at different positions, respectively, by varying the value "ya" of the center point "B" on the y-coordinate with a fixed value xb=0 on the x-coordinate. Each of the liquid-ejecting head is subjected to the observations under a microscope to estimate the condition of ink eject when the head is in operation. The obtained results are listed, in FIG. 18.

In FIG. 18, a liquid-ejecting head of Case No. 10 has the central point B of the heater 2 located at the position of yb=3.0 $\mu$m and an area ratio of S2/S1=1.5. An ejected volume of ink is about $10\times10^{-15}$ $m^3$ when the liquid-ejecting head is in operation. A velocity of ejected ink droplet is 20 m/sec. As a result of microscopic observation, the contacts between the heater 2 and the posterior end of ink column; 8 (i.e., a part of the interface between the bubble 6 and t he ink 3) (see FIG. 5D) is observed at 4.7 $\mu$sec after turning the power on, or 4.7 $\mu$sec after beginning of applying the driving signal to the heater 2 for driving the liquid-ejecting head. Also, the bubble had burst (see FIG. 5E) at 4.8 $\mu$sec after turning the power on. Therefore, the above contact is occurred prior to the burst of air bubble 6. Subsequently, as a result of the successive microscopic observation on the condition in which the posterior end of the ink droplet 7 passed by the orifice 5, the ink column 8 is shaped into a straight line without any doubt. Also, the condition of the ink droplet 7 placed on the printing medium is also excellent. In spite of continuous printing operation, furthermore, an enclosure of the printing apparatus is in good condition and not filled with ink mist.

Regarding Case No. 11, the same excellent condition of ink eject as that of Case No. 10 can be observed when the parameter "yb" is equal to 4.5 $\mu$m and an area ratio S2/S1 is equal to 1.857.

Regarding Case No. 12, a liquid-ejecting head is of yb=1.5 $\mu$m and S2/S1=1.222. An ejected volume of ink is about $10\times10^{-15}$ $m^3$ when the liquid-ejecting head is in operation. A velocity of ejected ink droplet is 20 m/sec. As a result of microscopic observation, however, the bubble 6 had burst at 4.5 $\mu$sec after turning the power on. At this time, the bubble 6 is disappeared, so that there is no interface between air bubble 6 and the ink 3. After the burst of air bubble 6, the contact point of the posterior end of the ink column 8 (but not a part of the interface between the bubble 6 and the ink 3) is shifted its position from the origin point to the negative side of they-coordinate (-Y direction). Subsequently, as a result of the successive microscopic observation on the condition in which the posterior end of the ink droplet 7 passed by the orifice 5, the ink column 8 is not shaped into a straight line but shaped into a curved line as shown in FIG. 8 and FIG. 9.

A liquid-ejecting head of Case No. 13 is of yb=6.0 $\mu$m and S2/S1=2.333. As a result of microscopic observation, the bubble 6 had burst at 4.8 $\mu$sec after turning the power on. The bubble 6 has burst almost concurrently with the contact between the heater 2 and the posterior end of the ink column 8. The contact point of the posterior end of the ink column 8 is shifted its position in the negative side of the y-coordinate. Subsequently, as a result of the successive microscopic observation on the condition in which the posterior end of the ink droplet 7 passed by the orifice 5, the ink column 8 is not shaped into a straight line but shaped into a curved line.

Regarding Case No. 14, on the other hand, a liquid-ejecting head is of yb=7.5 $\mu$m and S2/S1=3.000. An ejected volume of ink is about $10\times10^{-15}$ $m^3$ when the liquid-ejecting head is in operation. A velocity of ejected ink droplet is 20 m/sec. As a result of microscopic observation, however, the bubble 6 had burst at 4.6 $\mu$sec after turning the power on. At this time, the bubble 6 is disappeared, so that there is no interface between the bubble 6 and the ink 3. After the burst of air bubble 6, the contact point of the posterior end of the ink column 8 (but not a part of the interface between the bubble 6 and the ink 3) is shifted its position from the origin point to the negative side of the y-coordinate (-Y direction). Subsequently, as a result of the successive microscopic observation on the condition in which the posterior end of the link droplet 7 passed by the orifice 5, the ink column 8 is not shaped into a straight line but shaped into a curved line.

In the liquid-ejecting head of the present embodiment having the square-shaped heater 2, the heater 2 may be preferably provided so that the y-coordinate of the center point "B" is in the range of 5.0 to 3.0 $\mu$m ($5.0 \geqq yb \geqq 3.0$ $\mu$m) and the area ratio (S1/S2) is in the range of 2.0 to 1.5 ($2.0 \geqq S1/S2 \geqq 1.5$). These ranges stand on the boundary between the acceptable and unacceptable conditions. The acceptable condition is responsible for keeping the ink column 8 in the shape of a straight line and ejecting an ink droplet in a straight line. It is noted that the above ranges (i.e., $5.0 \geqq yb \geqq 3.0$ $\mu$m, $2.0 \geqq S2/S1 \geqq 1.5$) are not invariable. It is obvious that the ranges may be varied depending the factors including the physical properties of the liquid-ejecting head, such as dimensions, shape, and ink-eject operating condition, and the physical characteristic of ink. Therefore, it will be obvious to those skilled in the art that many modifications and variations of the above embodiment are possible to provide a more appropriate configuration thereof.

For attaining the excellent condition of ink eject by shifting the position of the square-shaped heater 2 toward the liquid chamber, there are upper and lower limits of the distance to be shifted because of the following reasons.

Figure 15B:
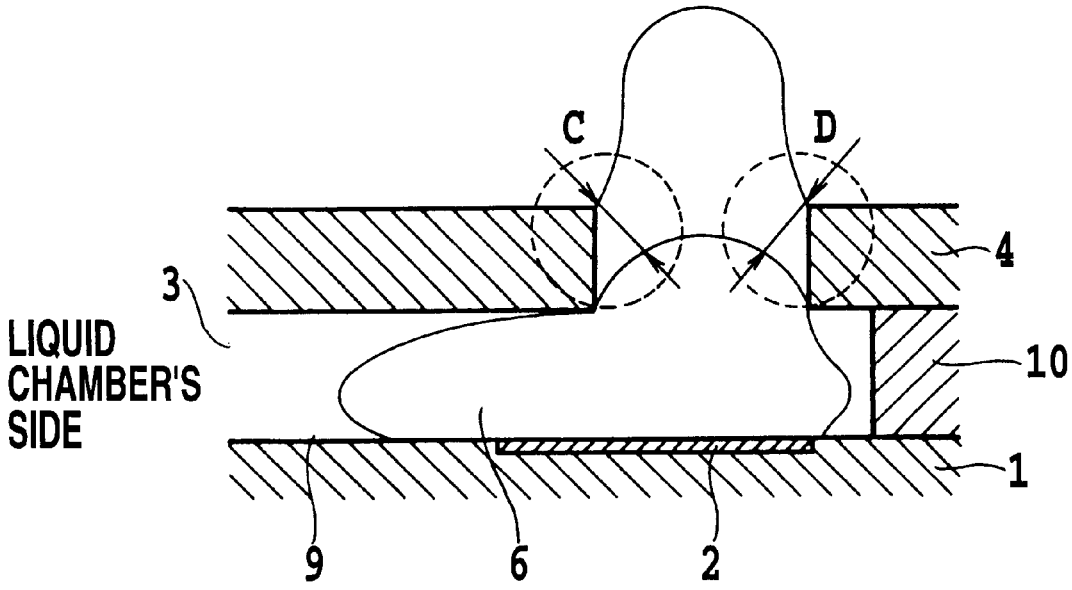

If the heater 2 is not shifted like that of the present embodiment, the liquid-ejecting head shows the same condition ink eject as that of FIGS. 14A and 14B. Thus, shifting the position of the heater 2 toward the liquid chamber relocates the branch point P of the ink flow toward the liquid chamber just as in the case with the first preferred embodiment described above. As shown in FIG. 15A, therefore, a flow rate of ink in the direction of the arrow "p1" is increased and the volume of ink to be pushed into the orifice 5 from the region "A" is increased, so that a flow rate of ink around an inner peripheral surface of the orifice 5 becomes substantially constant. As the ink eject operation proceeds, as shown in FIG. 15B, a thickness of ink membrane at the region indicated by the arrow "C" in the figure becomes almost equal to a thickness of ink membrane at the region indicated by the arrow "D" in the figure. Consequently, the excellent ink eject conditions as shown in FIGS. 5D, 5E, 5F and 5G can be obtained.

Figure 16A:
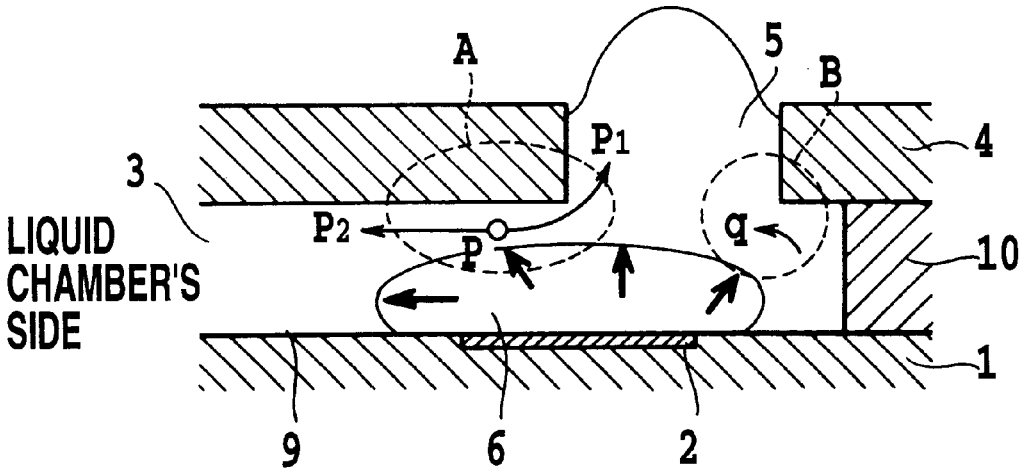
FIGS. 16A and 16B are cross sectional views of the major part of the liquid-ejecting head, respectively, for illustrating the behaviors of eject when a heater is shifted its position toward a liquid chamber in a liquid-ejecting head as a second embodiment of the present invention.
Figure 16B:
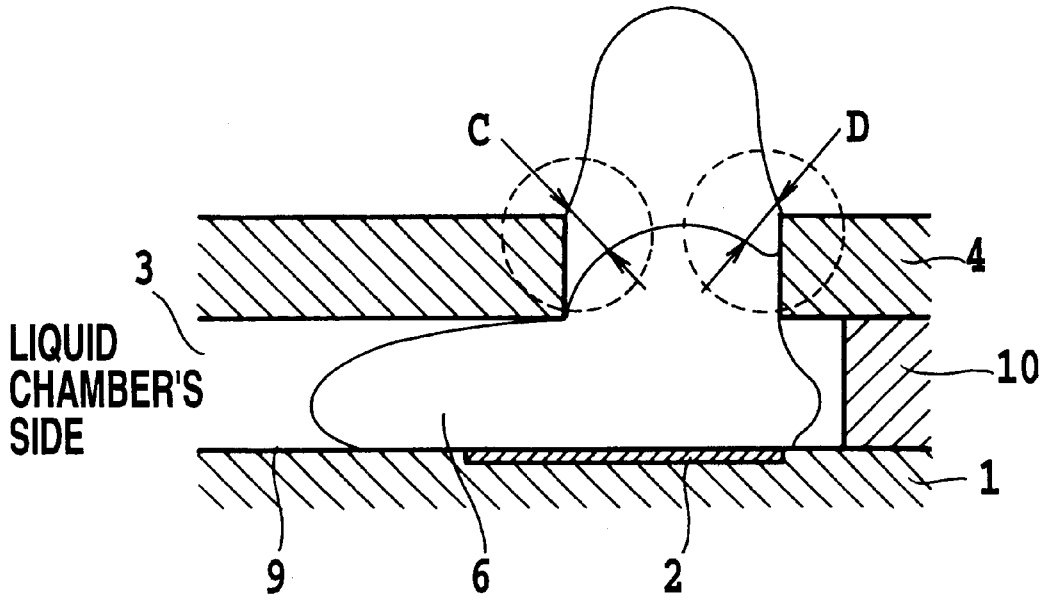

FIG. 16A and FIG. 16B illustrate that the heater 2 is further shifted toward the liquid chamber. In this case, the distance between the heater 2 and the wall 10 of ink flowing path is large more than required, so that the flow of ink 3 in the direction of the arrow "q" becomes weak, resulting in a lower quantity of ink flow along such a direction. In the region "A", on the other hand, the quantity of ink flow along the direction "P1" is increased because of the shift of the branch point "P" toward the liquid chamber. However, the increment of the quantity of ink flow along the direction "P1" has its upper limit because the loss of the bubbling energy toward the liquid chamber is increased. According to these facts, as shown in FIG. 16B, a thickness of ink membrane at the area "D" is smaller than a thickness of ink membrane at the area "C". As a result, the bubble 6 communicates with the atmosphere at the area "D" in advance of communicating with the area "C" (it may be occurred before the posterior of the ink column 8 makes contact with the heater 2). Therefore, the contact position of ink deviates from its right position, so that the favorable condition of ink eject cannot be attained.

A Method for Manufacturing a Liquid Ejecting Head

Referring now to FIGS. 11A, 11B, 11C, 11D, 11E, and 11F, we will describe a method for manufacturing a liquid ejecting head to be applied in the method of ejecting a of the present invention.

Figure 11A:
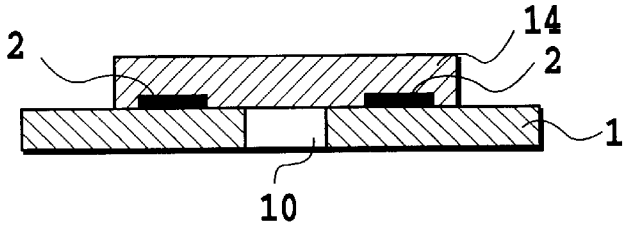
FIGS. 11A, 11B, 11C, 11D, 11E, and 11F are cross section views of the respective steps of the method for manufacturing the liquid-ejecting head of one of the preferred embodiments of the present invention.
Figure 11B:
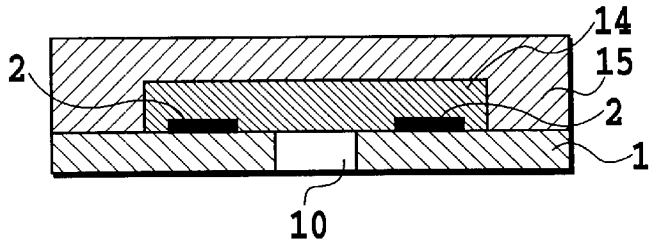

First of all, as shown in FIG. 11A, a substrate 1 made of glass, ceramic, plastic, metal, or the like is prepared.

However, any material and shape of the substrate 1 may be allowable without any limitation if it acts as a part of structural members that form a liquid flowing path and also acts as a structural member for supporting a material layer that forms both orifices and ink-flowing path. In addition, a required number of eject-energy generating members such as electrothermal converter elements and piezoelectric elements are located. Such an eject-energy generating member provides an ink with eject energy to ejectedroplets of the ink to perform a printing operation. If the electrothermal converter element is used as the above eject-energy generating member, the element heats a liquid's portion around the element to cause change of state in the liquid to generate an eject energy. If the piezoelectric element is used, the eject energy is generated by its mechanical vibration.

By the way, the above eject-energy generating means 2 is connected to a control-signal input electrode (not shown) for operating the element. In general, any functional layers including a protective layer may be provided for the purpose of improving the useful life of the eject-energy generating member. In the present invention, the above functional layer may be provided.

FIG. 11A illustrates a configuration of the substrate 1 through which an opening for supplying ink is previously formed. The opening may be formed by any method using means for making an opening in the substrate 1, including a mechanical device such as a drill, or an optical device using optical energies such as a laser, or a chemical procedure such as the process having the steps of making a resist pattern of the substrate 1 and performing a chemical etching on the substrate 1.

Alternatively, the ink-supplying opening 10 may be not formed on the substrate 1 but formed on a coating resin pattern described below so as to be made in the same layer where the orifices 5 are formed.

Subsequently, as shown in FIG. 11A, an ink-flowing path pattern 14 is formed on the substrate 1 using a dissolvable resin so as to cover the eject-energy generating means 2 described above with the resin. For making the ink-flowing path pattern, means that forms the pattern using a photosensitive material is the commonest means but not limited to. It is also possible to use other means such as one using a screen printing method. In the case of using the photosensitive material, the ink flowing path pattern 14 is dissolvable, so that it is possible to use a positive type resist or a solubility-variable type negative resist may be used.

For providing the substrate 1 having an ink supplying opening 1, the process of making a resist layer may be comprised of the steps of dissolving the photosensitive material into an appropriate solvent, applying the dissolved material on a film such as polyethylene terephthalate (PET), drying the film to make a dried film, and laminating the dried film on the substrate 1. Preferably, the dried film may be vinylketone-based collapsible high-molecular compound including polymethyl isopropyl ketone, and polyvinyl ketone. Such a compound maintains its film-forming performance before the step of irradiating the compound with light, so that it can be easily laminated on the ink-supplying opening 10.

Alternatively, a filler to be removed by the subsequent step may be placed on the ink-supplying opening 10 to make a coating film by means of a general spin coating method, a roll coating method, or the like.

Furthermore, a coating resin layer 15 is formed on the dissolvable resin layer (which forms the ink flowing path pattern 14) by a general spin coating method, a roll coating method, or the like. In the step of forming the coating resin layer 15, it is required that the dissolvable resin pattern (pattern 14) is not deformed. That is, it is required that a solvent should be selected so that the selected solvent does not dissolve the dissolvable resin layer (which forms pattern 14) when the process including the steps of dissolving a raw material of the coating resin layer 15 in such a solvent and laminating the dissolved material on a layer that forms the resin layer pattern 14 by any coating method such as a spin coat or roll coat method.

Now, the coating resin layer 15 will be described in detail. The coating resin layer 15 may be preferably of a photosensitive type because of its advantage of forming ink-ejecting orifices accurately by means of a photolithography. Such a photosensitive coating resin layer 15 requires a high mechanical strength as a structural material, adhesion properties to the substrate 1, durability to ink, and so on in addition to a resolution for patterning the fine pattern of ink orifices. It is found that a cationic polymerization cure material of epoxy resin may be provided as the structural material because of its excellent properties of strength, adherence, ink durability, and so on. Further, it is also found that the epoxy resin has excellent patterning and shaping characteristics if it is in a solid state at ordinary temperatures.

The cationic polymerization cure material of epoxy resin has a high cross-linking density (high Tg) compared with that of a typical cure material of acid anhydride or amine, so that it shows excellent characteristics of a structural material. In addition, using the epoxy resin in a solid state at ordinary temperatures enables the patterning and shaping with great accuracy because the diffusion of a polymerization initiating species into the epoxy resin is substantially blocked, where the polymerization initiating species is generated from a cationic polymerization initiator by an irradiation of light.

The step of laminating the coating resin layer 15 on the dissolvable resin may be preferably comprised of dissolving a coating resin in a solid state at ordinary temperatures into a solvent and then laminating the coating resin layer 15 on the dissolvable resin by means of spin coat.

Using the spin coat method known as a thin film coating technique enables the formation of the uniform coating resin layer 15 with great accuracy. Therefore, ejecting a minute droplet can be easily attained as a result of shortening the distance (O-H distance) between the eject-energy generating means 2 and the orifice. Such a short distance between them is long thought to be beyond the prior art achievement.

If the so-called negative type photosensitive resin is used as a material of the coating resin layer 15, undesirable reflection and scum (development residual) are generally caused from the surface of the substrate 1. In the present embodiment, the present process has little effect on undesirable reflection from the substrate 1 because it comprises the steps of forming a coating resin layer 15 on an ink-flowing path pattern 14 formed by a dissolvable resin and forming a orifice pattern on the coating resin layer 15. In addition, the present process has also little effect on undesirable scum to be generated in the step of development because the scrum can be removed by washing the dissolvable resin that forms the ink flowing path pattern 14.

Solidified epoxy resins at ordinary temperatures to be used in the present invention include the products having molecular weights of 900 or more obtained from the reaction bis-phenol A and epichlorohydrin, the products obtained from the reaction between bromosulfophenol A and epichlorohydrin, the products obtained from the reaction between phenol novolac or o-cresol novolac and epichlorohydrin, and multifunctional epoxy resin having oxycyclohexane skeleton disclosed in Japanese Patent Application Laying-open Nos. 60-9216 (1985) and 2-140219 (1990). It is apparent that the present invention is not limited to such compounds.

Cationic photo-polymerization initiators for curing the above epoxy resins include aromatic iodonium salt, aromatic sulfonium salt (see J. POLYMER SCI: Symposium No. 556383-395, 1976), and SP-150 and SP-170 which are trade names of the products commercially available from ASAHI DENKA KOGYO K. K. (JAPAN).

Furthermore, the above photo-polymerization initiator in combination of a reducing agent accelerates a cationic polymerization under heat (i.e., the density of cross-linking is increased as compared with the use of the initiator alone). However, the reducing agent should be selected so as to be appropriately provided as a so-called redox type initiation system that only reacts at high temperatures, preferably 60° C. or more. The reducing agent may be selected from copper compounds, preferably copper triflate (copper trifluoromethane Sulfonic acid (II)). In addition, ascorbic acid or the like may be advantageously used as a reducing agent. If higher cross-linking density (high Tg) is required because of the increased number of nozzles to be formed by ink-ejecting orifices (for high speed printability), the use of non-neutral ink (for improvement in waterproof property of colorant), or the like, the density of cross-linking may be increased by using the above reducing agent as a solvent in the steps of dipping and heating the coating resin layer 15 from the development as described below.

Furthermore, the composition described above may be further comprised of an additional agent in case of necessity. A plasticizer may be added for the purpose of decreasing an elasticity modulus of the epoxy resin. A silane coupling agent may be added for the purpose of increasing the strength of contact with the substrate.

Figure 11C:
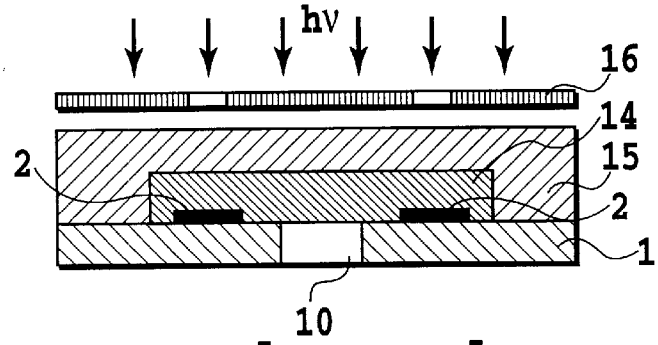

Next, as shown in FIG. 11C, a pattern exposure is subjected to the-photosensitive coating resin layer 15 made of the above compound through a mask 16. The photosensitive coating resin layer 15 is of a negative type, so that portions responsible for forming ink-ejecting orifices 5 and portions responsible for electrical connections can be covered by the mask that intercepts the rays.

A pattern exposure may be performed by ultraviolet (UV) rays, Deep-UV rays, electron beam, Xrays, or the like, which can be selected so as to cover the photosensitive wavelength region of the cationic photo-polymerization initiator to be used.

Comparing with the method of laminating the orifice plate and the substrate together, all of the steps described above may utilize the conventional photolithography to determine the position of each component of the liquid-ejecting head with a precision never before possible. The photosensitive coating resin layer 15 worked with the pattern exposure may be subjected to heat for facilitating the reaction as necessary. Further, it is also found that the epoxy resin has excellent patterning and shaping characteristics if it is in a solid state at ordinary temperatures described above. Because, the diffuseness of cationic photo-polymerization initiator worked with the pattern exposure can be restricted.

Figure 11D:
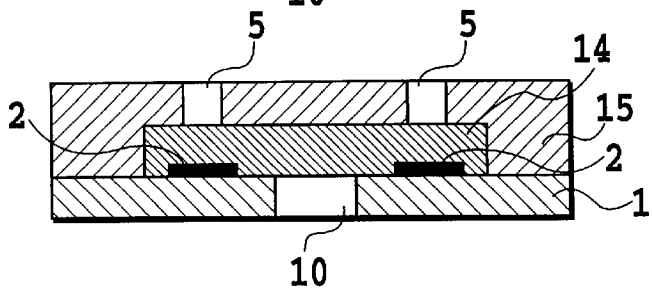
Figure 11E:
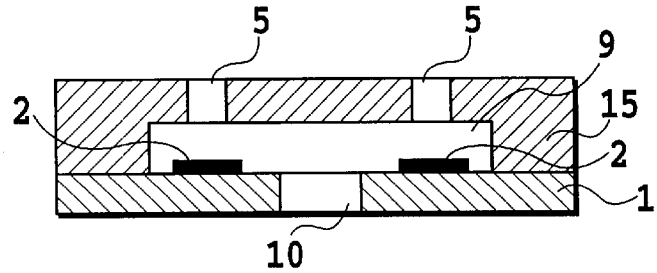

Next, the photosensitive coating resin layer 15 subjected to the pattern exposure is developed by using an appropriate solvent to form a plurality of orifices 5 as shown in FIG. 11D. Alternatively, the dissolvable resin layer that forms a pattern 14 of ink-flowing path, concurrently with the development of unexposed photosensitive covering resin layer 15. In general, however, a plurality of the same or differently shaped head units are arranged on a single substrate 1. The substrate 1 having a plurality of such head units is cut into pieces to be used as liquid-ejecting heads. Taking countermeasure against debris being generated in the cutting step, only the photosensitive coating resin layer 15 may be selectively developed as shown in FIG. 11D so that the resin layer that forms the pattern 14 remains intact during the cutting step. Therefore, debris generated by the cutting step does not trapped into the inside because of the presence of the resin layer that forms the pattern 14. After such a cutting step, the resin layer 14 is developed as shown in FIG. 11E. In addition, scum (development residue) generated at the time of developing the photosensitive coating resin layer 15 is eluted simultaneously with the dissolvable resin layer that forms the ink flowing path pattern 14, so that there is no development residue in the nozzle.

For increasing the density of cross-linking if required, the process proceeds to the step of post curing where the photosensitive coating resin layer 15 on which ink following paths 9 and orifices 5 is immersed in a solution containing a reducing agent and heating at an elevated temperature. Thus, the density of cross-linking is further increased and also the properties of adhesion to substrate 1 and durability to ink are excellent. Alternatively, the step of immersing the photosensitive coating resin layer 15 into the solution (e.g., copper ion containing solution) and heating the layer 15 at an elevated temperature may be performed just after the steps of pattern exposure and development for the photosensitive coating resin layer 15 to form orifices 5. Subsequently, the dissolvable resin layer 14 that forms the pattern 14 of ink flowing path may be eluted. In such a step of immersing and heating, the immersing may be concurrently performed with the heating or performed after the heating.

The reducing agent may be any material responsible for the action of reduction, preferably one of the compounds containing copper ion, including copper triflate, cupper acetic acid, and copper benzoic acid. Among these chemical reductants, copper triflate shows an excellent effect on a reduction reaction. In addition to those compounds, ascorbic acid may be also useful.

Figure 11F:
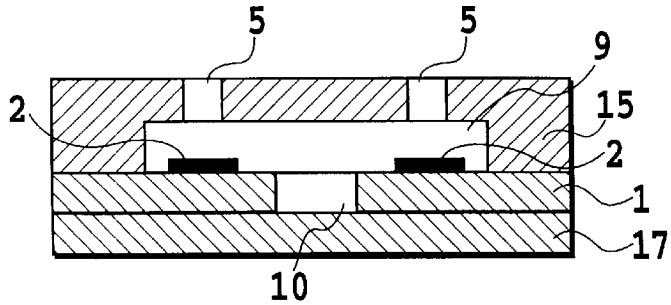

Further to the steps described above, an additional ember 17 for supplying ink and electrical contacts (not shown) for driving the means 2 for generating eject-energies are provided on the substrate 1 on which the ink-flowing path 9 and the ink orifices 5 are formed (FIG. 11F). Consequently, an inkjet liquid-ejecting head of the present invention is obtained.

In the present embodiment, the formation of orifices 5 has performed by the photolithography. However, the present invention is not limited to such a photolithography, it is also possible to use any of other technologies such as dry-etching using oxygen plasma and excimer laser. The resin pattern is able to protect the substrate 1 to avoid any damage if the orifices 5 are formed by excimer laser or dry etching, so that a head can be provided with high precision and reliability. Furthermore, the coating resin layer 15 may be prepared using any thermosetting resin instead of the photosensitive one if the orifices 5 are formed by excimer laser or dry etching.

It is noted that the present liquid ejecting head may be applied on a full line type liquid-ejecting head that prints the information simultaneously on the whole width of printing paper and also applied on a multi-color type liquid-ejecting head.

The liquid-ejecting head to be used in the present method of ejecting liquid may preferably use a solidified ink that can be liquefied when the predetermined temperature has been reached.

Configuration of Liquid-ejecting Apparatus

A preferred embodiment of liquid-ejecting apparatus on which the liquid-ejecting head described above is mountable will be now described.

Figure 13:
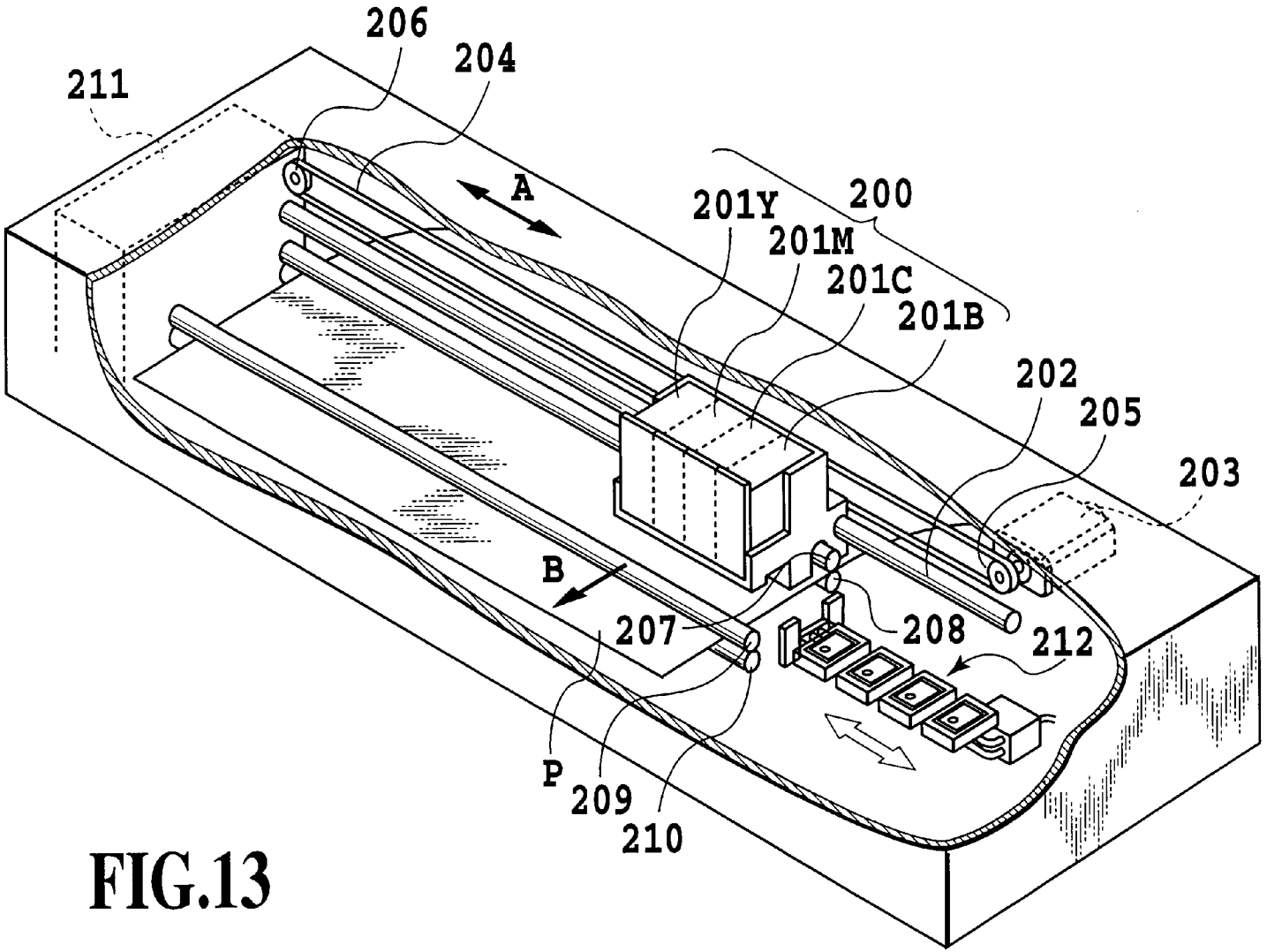
FIG. 13 is a partially broken perspective view for illustrating one of the configurations of a liquid-ejecting apparatus in accordance with the present invention.

In FIG. 13, the reference numeral 200 denotes a carriage on which the liquid-ejecting head described above is removably mounted. In this embodiment, four heads are mounted on the carriage 200 in conjunction with a tank 201Y of yellow color, a tank 201M of magenta color, a tank 201C of cyan color, and a tank 201B of black ink, respectively, so as to correspond to these ink colors.

The carriage 200 is supported by a guide shaft 202 and shift its position as a reciprocating movement along the guide shaft 202 in the directions of the double headed allows "A" by motive force of an endless belt 204 to be driven by a motor 203 in the forward or reverse direction. The endless belt 204 runs between two pulleys 205, 206.

A sheet of paper "P" as a printing medium is intermittently transferred in the direction the arrow "B" perpendicular to the direction of the arrow "A". An upper stream portion of the printing paper "P" is sandwiched between a pair of roller units 207, 208 and a down stream portion thereof is sandwiched between another pair of roller units 209, 210, so that the printing paper "P" is transferred in parallel to the eject surface of the liquid-ejecting head. Each of rollers receives its motive force from a driving device 211. Alternatively, the rollers may be rotated by the motor 203.

The carriage 200 stops at a home position if required at the time of initiating the printing movement or during the printing movement. There are capping members 212 on the home position. Each of the capping members 212 is connected to a sucking means for recovering the ejecting ability of the head by preventing the generation of clog in the orifice by the forcefully sucking the ink.

Embodiment of Liquid-ejecting Head

Figure 19:
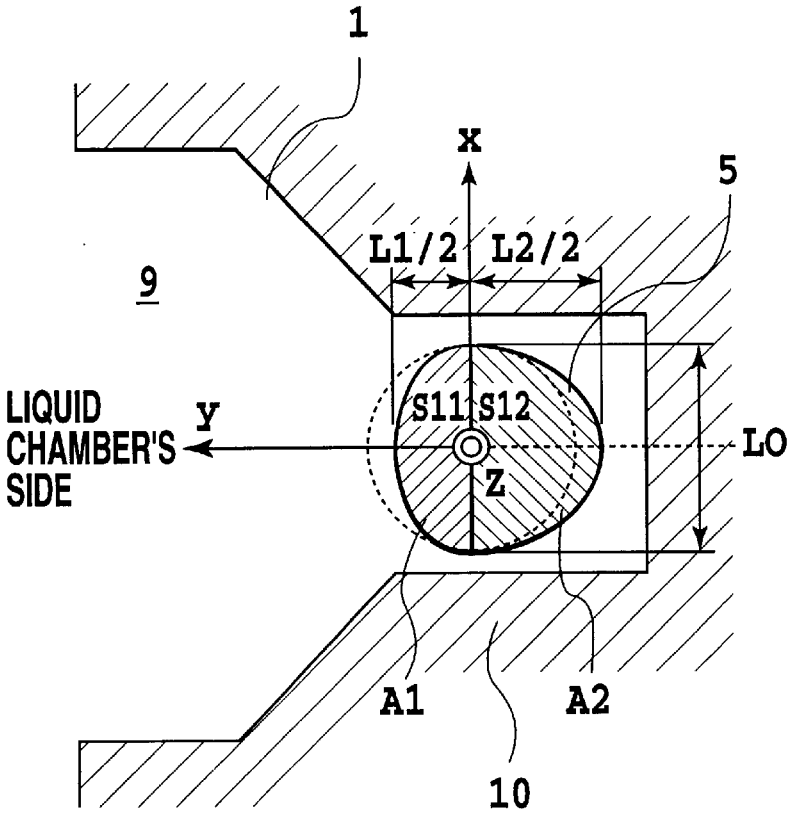
FIG. 19 is a cross sectional view of the major part of a liquid-ejecting head as a third preferred embodiment of the present invention.
Figure 20:
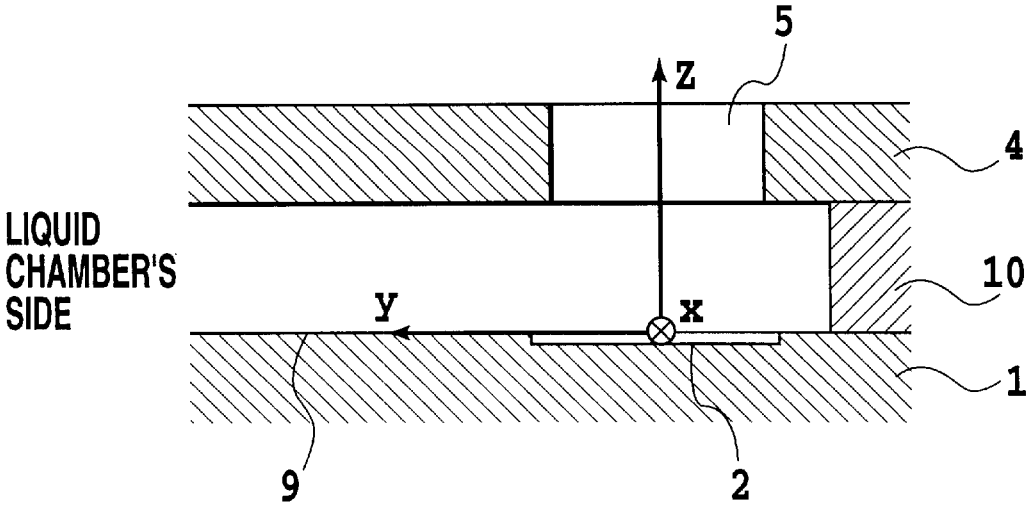
FIG. 20 is a cross sectional view of the major part of the liquid-ejecting head shown in FIG. 19.

FIG. 19 and FIG. 20 illustrate a liquid-ejecting head as a third preferred embodiment of the present invention. FIG. 19 is a cross sectional view of the major part of the liquid-ejecting head. In FIG. 19 and FIG. 20, there is shown the x-, y-, and z-coordinates. In FIG. 19, a solid line represents the outline of an orifice 5 for the convenience of explanation. A shape of a cross section of the orifice 5 is represented as the shape in which two different ellipses having different hatching patterns overlapped one another. These two ellipses are assumed on an orifice plate 4 and overlapped so that their centroids are coincident with each other. A common centroid of the figures is projected on the substrate 1 to obtain a projected point. The projected point is defined as an origin point of the x-, y-, and z-coordinates. The y-coordinate defines the position of point, line, or plan extending from the origin point to any point in the direction of the liquid chamber (not shown). The x-coordinate is provided as one perpendicular to the y-coordinate. The z-coordinate is in the direction of ejecting an ink droplet and provided as one perpendicular to both the x-coordinate and y-coordinate.

As shown in FIG. 19, a portion of the ellipse located on a region of $y>0$ is defined as "A1" (semi-ellipse) and another portion of the ellipse located on a region of $y \leqq 0$ is defined as "A2" (semi-ellipse). In this case, the cross sectional shape of the orifice 5 (i.e., sectional form) is represented as a combination of the areas A1 and A2. An area of the region "A" is represented by "S11" and an area of the region "A2" is represented by "S12", so that an area ratio is represented by "S12/S11". In this embodiment, it is consistently defined as S12/S11$\geqq$1.0. There are two axes of symmetry of the ellipse. A major axis of the region Al and a minor axis of the region A2 are coincided with each other, so that they are represented by a common axis. A length of the common axis is "L0", a length of a minor axis of the region A1 is "L1" and a length of a major axis of the region A2 is "L2". In FIG. 19, a dotted line represents an imaginary circle having a center coincident with the origin point of the coordinate system. .

FIG. 20 is a cross sectional view along the y-z plane of FIG. 19. Referring now to FIG. 20, an ink chamber (not shown) is formed by performing an anisotropic etching on a silicon substrate 1. Ink flows from the ink chamber to the orifice 5 through an ink-flowing path 9 and then an ink droplet is ejected from the orifice 5. A heater 2 is provided just under the orifice 5. A centroid of region on the heater 2 is coincided with the origin point of the coordinate system. The heater 2 is responsible for ejecting an ink droplet from the orifice 5 by providing a thermal energy on ink supplied from the ink-flowing path. Structural parts of the liquid-flowing path including partitions are formed by the known manufacturing technologies in the art such as light exposure and etching.

In this embodiment, a driving current to be applied on the heater 2 is 14.5 volts with a pulse width of 4 μsec. Ink used in the present embodiment is formulated by dissolving 4% of C.I food black 2 into an aqueous solution consisting of 80% of diethylene glycol (DEG) and 20% of water To be more specific, a height of the ink-flowing path 9 formed on the space between-the substrate 1 and the orifice plate 4 is 13.0 μm, and a thickness of the orifice plate 4 is 14.0 μm. The heater 2 is formed in the shape of a square where a length of each of four sides is 30.0 μm and has a centroid coincident with the origin point of the coordinate system. In addition, a length of the common axis LO is 21.0 μm.

In this embodiment, furthermore, liquid-ejecting heads characterized by the following parameters are prepared. Commonly, the length "L0" is defined so as to equal to the length "L2", so that the region A2 is provided as a perfect half-circle. In addition, the length "L1" is provided as a variable parameter. In this embodiment, therefore, five deferent liquid-ejecting heads are prepared so as to correspond to five different values of the parameter listed in FIG. 21, respectively. For each value of the parameter, the liquid-ejecting head thus obtained is subjected to the observations under a microscope to estimate the condition of ejecting ink droplets when the head is in operation. The obtained results are listed in FIG. 21.

In FIG. 21, a liquid-ejecting head having the parameters where "L1" is 13.0 μm and the axis ratio (L2/L1) is 1.61 is provided as Case No. 1 for the observation. An ejected volume of ink is about $8\times10^{-15}$ $m^3$ when the liquid-ejecting head is in operation. A velocity of ejected ink droplet is about 16 m/sec. As a result of microscopic observation, the contact between the heater 2 and the posterior end of the ink column 8 (i.e., a part of the interface between the bubble 6 and the ink 3) (see FIG. 5D) is observed at 5.8 μsec after turning the power on, or, 5.8 μsec after beginning of applying the driving signal to the heater 2 for driving the liquid-ejecting head. Also, the bubble 6 had burst (see FIG. 5E) at 6.0 μsec after turning the power on. Therefore, the above contact is occurred prior to the burst of air bubble 6. Subsequently, as a result of the successive microscopic observation on the condition in which the posterior end of the ink droplet 7 passed by the orifice 5, the ink column 8 is shaped into a straight line without any doubt as shown in FIG. 5E and FIG. 5F. Also, the condition of the ink droplet 7 placed on the printing medium is also excellent. In spite of continuous printing operation, furthermore, an enclosure of the printing apparatus is in good condition and not filled with ink mist.

Regarding Case No. 2 and No. 3, the same excellent condition of ink eject as that of Case No. 1 when "L1" is 14.0 μm in Case No. 2 and "L1" is 15.0 μm in Case No. 3. In these Cases No. 2 and No. 3, the accuracy of placing an ink droplet 7 on the predetermined area of the printing medium is also excellent. In spite of continuous printing operation, furthermore, an enclosure of the printing apparatus is in good condition and not filled with ink mist.

A liquid-ejecting head of Case No. 4 has the parameters where "L1" is 16.0 μm and the axis ratio (L2/L1) is 1.31. An ejected volume of ink is about $8\times10^{-15}$ $m^3$ when the liquid-ejecting head is in operation. A velocity of ejected ink droplet is about 16 m/sec. As a result of microscopic observation, however, the bubble 6 had burst at 5.5 μsec after turning the power on. At this time, the bubbler 6 is disappeared, so that there is no interface between the bubble 6 and the ink 3. After the burst of air bubble 6, the contact point "N" of the posterior end of the ink column 8 (but not a part of the interface between the bubble 6 and the ink 3) is shifted its position from the origin point to the negative side of the y-coordinate as shown in FIG. 7. Subsequently, as a result of the successive microscopic observation on the condition in which the posterior end of the ink droplet 7 passed by the orifice 5, the ink column 8 is not shaped into a straight line but shaped into a curved line without any doubt as shown in FIG. 8 and FIG. 9.

Regarding the liquid-ejecting head of Case No. 5, "L1" is 12.0 μm and an axis ratio (L2/L1) is 1.75. An ejected volume of ink is about $10\times10^{-15}$ $m^3$ and a velocity of ejected ink droplet is about 16 m/sec when the liquid-ejecting head is in operation. As a result of microscopic observation, the bubble 6 had burst at 6.0 μsec after turning the power on. The bubble 6 has burst almost concurrently with the contact between the heater 2 and the posterior end of the ink column 8. The contact point of the posterior end of the ink column 8 is almost on the origin point in spite of being shifted its position slightly in the negative side of the y-coordinate. Subsequently, as a result of the successive microscopic observation on the condition in which the posterior end of the ink droplet 7 passed by the orifice 5, the ink column 8 is shaped substantially into a straight line as shown in FIG. 5E and FIG. 5F. In addition, the condition of the ink droplet 7 placed on the printing medium is also acceptable. In spite of continuous printing operation, furthermore, an enclosure of the printing apparatus is in good condition and not filled with ink mist.

In the present embodiment, as described above, a length "L1" of a minor axis of the ellipse region "A1" is provided as a variable parameter and other factors are provided as fixed parameters. As a result, L1=16.5 μm (axis ratio: L2/L1=1.31) stands on the boundary between the acceptable and unacceptable conditions. The acceptable condition is responsible for keeping the ink column 8 in the shape of a straight line and ejecting an ink droplet 7 in a straight line. For attaining the excellent condition of ink eject with stability, the relationship between L1 (length of the minor axis) and L2 (length of the major axis) should be represented by the following formula.

$$1.7 \geqq L2/L1 \geqq 1.4$$

It is noted that the value of L1 (=16.0 μm) is not invariable. It is obvious that the value of L1 may be varied depending on the factors including the physical properties of the liquid-ejecting head, such as dimensions, shape, and ink-eject operating condition, and the physical characteristic of ink. Therefore, it will be obvious to those skilled in the art that many modifications and variations of the above embodiment are possible to provide a more appropriate configuration thereof.

In the present invention, as described above, an excellent ink-eject condition can be attained by appropriately changing the shape of orifice because of the following reasons.

The change in the shape of orifice 5 as described in the present embodiment mean that an area of the half circle placed on the positive side of the y-coordinate axis and defined by intersecting an perfect circle with the x-coordinate axis is decreased from a whole area of a perfect circle shown in FIG. 19 by a dot line with a center coincident with an origin point of the coordinates. Put another way, a radius of the orifice 5 along the positive side of the y-coordinate axis is decreased. That is, the distance from the origin to a point of intersection of the positive side of the y-coordinate axis and the track (solid line) of a circle is lessened. Just as with FIG. 14A, the position of the branch point P (i.e., stagnant point) of the ink-flowing directions is not much shifted. However, the lower edge portion of the orifice 5 positioned above the branch point "P" is shifted to the minus side of the y-coordinate (the right side of FIG. 14A). Consequently, the amount of ink flowing toward the direction of the arrow "P1" is increased, so that the amount of ink to be pushed into the orifice 5 from the area "A" at the beginning of producing a bubble. In FIG. 14B, by the way, a thickness of the ink membrane of the region "C" is indicated by two arrows facing to each other, and also a thickness of the ink membrane of the region "D" is indicated by two arrows facing to each other. During the progress of the ink-eject, a thickness of the ink membrane of the region "C" is increased to become the same thickness as that of the region "D". That is, a thickness of an ink membrane along an inter peripheral portion of the orifice 5 becomes substantially uniform as a result of increasing the thickness of the ink membrane of the region "C" by narrowing an area of the orifice 5 on the positive side of the y-coordinate axis. As a result, the subsequent steps of the ink-eject proceed as excellent ink-eject conditions like those of shown in FIGS. 5D, 5E, 5F and 5G.

In first and second embodiments of liquid-ejecting head described above, the same effects as those described above can be obtained by shifting the position of the heater 2 toward liquid chamber side. That is, the change in the relative position between the heater 2 and the orifice 5 leads to narrow an area of the orifice 5 on the positive side of the y-coordinate axis simultaneously with the relative increase in an area thereof on the negative side, so that the same effects can be obtained. However, it is difficult to optimize the decrease or the increase in the orifice's areas on both sides of the y-coordinate axis, especially at the time of forming an orifice having an opening in the shape of a circle. In spite of moving the heater 2 or the orifice 5 independently, the orifice's areas on the positive and negative sides cannot be adjusted independently. Thus, it is difficult to obtain the process for making an adjustment to an area of the orifice 5 with excellent versatility. The orifice's area is closely related to the amount of ink to be ejected, so that the orifice's area should be easily adjusted on an as needed basis. In the present embodiment, the process for making an adjustment to an area of the orifice with excellent versatility can be provided.

Fourth Preferred Embodiment of Liquid-ejecting Head

In this embodiment, liquid-ejecting heads are prepared where the length "L0" of the common axis is equal to the length "L1" of a minor axis of the ellipse region "A1" (i.e. the region "A1" is a perfect semicircle) and the length "L2" of a major axis of the region A2 is varied as a parameter. The conditions of ink-eject of each head being driven are observed by a microscopy and the results are listed in FIG. 22.

In FIG. 22, Case No. 6 is a liquid-ejecting head where the length "L2" a major axis of the region A2 is 30.0 $\mu$m and the axis ratio (L2/L1) is 1.43. An ejected volume of ink is about $11\times10^{-15}$ $m^3$ when the liquid-ejecting head is in operation. A velocity of ejected ink droplet is 20 m/sec. As a result of microscopic observation, the contact between the heater 2 and the posterior end of an ink column 8 (i.e., a part of the interface between the bubble 6 and the ink 3) (see FIG. 5D) is observed at 4.9 $\mu$sec after turning the power on, or 4.9 $\mu$sec after beginning of applying the driving signal to the heater 2 for driving the liquid-ejecting head. Also, the bubble 6 had burst (see FIG. 5E) at 5.0 $\mu$sec after turning the power on. The above contact is occurred prior to the burst of the bubble 6. Subsequently, as a result of the successive microscopic observation on the condition in which the posterior end of the ink droplet 7 passed by the orifice 5, the ink column 8 is shaped into a straight line without any doubt. Also, the condition of the ink droplet 7 placed on the printing medium is also excellent. In spite of continuous printing operation, furthermore, an enclosure of the printing apparatus is in good condition and not filled with ink mist.

Regarding Case No. 2 and No. 3, the same excellent condition of ink eject as that of Case No. 1 when "L1" is 14.0 $\mu$m in Case No. 2 and "L1" is 15.0 $\mu$m in Case No. 3. In these Case No. 2 and No. 3, the accuracy of placing an ink droplet 7 on the predetermined area of the printing medium is also excellent. In spite of continuous printing operation, furthermore, an enclosure of the printing apparatus is in good condition and not filled with ink mist.

Regarding Case No. 10, a liquid-ejecting head has the length "L1" of 29.0 $\mu$m and the axis ratio (L2/L1) of 1.38. An ejected volume of ink is about $11\times10^{-15}$ $m^3$ when the liquid-ejecting head is in operation. A velocity of ejected ink droplet is about 16 m/sec. As a result of microscopic observation, however, the bubble 6 had burst at 5.0 $\mu$sec after turning the power on. At this time, the bubble 6 is disappeared, so that there is no interface between the bubble 6 and the ink 3. After the burst of air bubble 6, the contact point "N" of the posterior end of the ink column 8 (but not a part of the interface between the bubble 6 and the ink 3) is shifted its position from the origin point to the negative side of the y-coordinate as shown in FIG. 7. Subsequently, as a result of the successive microscopic observation on the condition in which the posterior end of the ink droplet 7 passed by the orifice 5, the ink column 8 is not shaped into a straight line but shaped into a curved line as shown in FIG. 8 and FIG. 9.

In the present invention, as described above, the length "L2" of the major axis of the ellipse region "A2" in the Y direction is provided as a variable parameter and other factors are being fixed. The condition in which L2=29.0 $\mu$m (L2/L1=1.38) stands on the boundary between the acceptable and unacceptable conditions. The acceptable condition is responsible for keeping the ink column 8 in the shape of a straight line and ejecting an ink droplet 7 in a straight line.

In the present embodiment, the upper limit of "L2" is 33.0 $\mu$m in effect, which corresponds to a point where a portion of the ink-flowing path 10 on the negative side of the y-coordinate is coincident with a distal end (i.e., situated farthest from the origin) of the orifice 5 on the negative side of the y-coordinate. The upper limit is varied depending on the shape of the liquid-ejecting head. For more stable ink-eject condition, it is preferable that the upper limit of "L2" satisfies the following mathematical expression.

$$1.6 \geqq L2/L1 \geqq 1.4$$

It is noted that the value of L2 (=29.0 $\mu$m) is not invariable. It is obvious that the value of L2 may be varied depending the factors including the physical properties of the liquid-ejecting head, such as dimensions, shape, and ink-eject operating condition, and the physical characteristic of ink. Therefore, it will be obvious to those skilled in the art that many modifications and variations of the above embodiment are possible to provide a more appropriate configuration thereof.

In the present invention, as described above, an excellent ink-eject condition can be attained by appropriately changing the shape of orifice because of the following reasons.

The change in the shape of orifice 5 as described in the present embodiment mean that an area of the half circle placed on the negative side of the y-coordinate axis and defined by intersecting an perfect circle with the x-coordinate axis is increased from a whole area of a perfect circle shown in FIG. 19 by a dot line with a center coincident with an origin point of the coordinates. Put another way, a radius of the orifice 5 along the negative side of the y-coordinate axis is increased. Just as with FIG. 14A, the position of the branch point "P" (i.e., stagnant point) of the ink-flowing directions is not much shifted, while the amount of ink flowing toward the direction of the arrow "q" is decreased. Thus, the amount of ink that flows in the direction of "P1" is relatively increased and the amount of ink to be pushed into the orifice 5 from the region "A" is relatively increased. In FIG. 14B, by the way, a thickness of the ink membrane of the region "C" is indicated by two arrows facing to each other, and also a thickness of the ink membrane of the region "D" is indicated by two arrows facing to each other. During the progress of the ink-eject, a thickness of the ink membrane of the region "C" is increased to become the same thickness as that of the region "D". That is, a thickness of an ink membrane along an inter peripheral portion of the orifice 5 becomes substantially uniform as a result of increasing the thickness of the ink membrane of the region "C" by broadening an area of the orifice 5 on the negative side of they-coordinate axis. As a result, the subsequent steps of the ink-eject proceed as excellent ink-eject conditions like those of shown in FIGS. 5D, 5E, 5F and 5G.

Fifth Preferred Embodiment of Liquid-ejecting Head

In this embodiment, liquid-ejecting heads are prepared where both "L1" and "L2" are varied as parameters. The conditions of ink-eject of each head being driven are observed by a microscopy and the results are listed in FIG. 23.

In FIG. 23, Case No. 11 is a liquid-ejecting head where the length "L1" is 14.0 μm and the length "L2" is 28.0 μm and the axis ratio (L2/L1) is 2.0. An ejected volume of ink is about $10\times10^{-15}$ $m^3$ when the liquid-ejecting head is in operation. A velocity of ejected ink droplet is about 16 m/sec. As a result of microscopic observation, the contact between the heater 2 and the posterior end of an ink column 8 (i.e., a part of the interface between the bubble. 6 and the ink 3) (see FIG. 5D) is observed at 5.3 μsec after turning the power on, or 5.3 μsec after beginning of applying the driving signal to the heater 2 for driving the liquid-ejecting head. In this case, a bubble 6 had burst. (see FIG. 5E) at 5.5 μsec after turning the power on. Therefore, the above contact is occurred prior to the burst of the bubble 6. Subsequently, as a result of the successive microscopic observation on the condition in which the posterior end of the ink droplet 7 passed by the orifice 5, the ink column 8 is shaped into a straight line without any doubt. Also, the condition of the ink droplet 7 placed on the printing medium is also excellent. In spite of continuous printing operation, furthermore, an enclosure of the printing apparatus is in good condition and not filled with ink mist.

Regarding Case No. 12, a liquid-ejecting head has the length "L1" of 10.0 μm and the length "L2" of 30.0 μm and the axis ratio (L2/L1) of 3.0. An ejected volume of ink is about $9\times10^{-15}$ $m^3$ when the liquid-ejecting head is in operation. A velocity of ejected ink droplet is about 16 m/sec. As a result of microscopic observation, the bubble 6 had burst at 5.3 μsec after turning the power on. The bubble 6 has burst almost concurrently with the contact between the heater 2 and the posterior end of the ink column 8. The contact point of the posterior end of the ink column 8 is almost on the origin point in spite of being shifted its position slightly in the negative side of the y-coordinate. Subsequently, as a result of the successive microscopic observation on the condition in which the posterior end of the ink droplet 7 passed by the orifice 5, the ink column 8 is shaped substantially into a straight line as shown in FIG. 5E and FIG. 5F. In addition, the condition of the ink droplet 7 placed on the printing medium is also acceptable. In spite of continuous printing operation, furthermore, an enclosure of the printing apparatus is in good condition and not filled with ink mist.

In the present invention, as described above, both "L1" and "L2" are provided as variable parameters and other factors are being fixed. Therefore, the present embodiment provides a high degree of flexibility in design specifications of the liquid-ejecting head as the range of the axis ratio (L2/L1) can be broadened.

If the axis ratio (L2/L1) is less than 3.0 (i.e., L2/L1>3.0), in the "y>0" region in the vicinity of the orifice 5, the loss of energy for ejecting ink in the ink-flowing path 9 is increased. In practice, therefore, the upper limit of the axis ratio (L2/L1) is 3.0 in effect. For more stable ink-eject condition, it is preferable that the upper limit of "L2/L1" satisfies the following mathematical expression.

$$3.0 \geqq L2/L1 \geqq 1.4$$

It is noted that the above range is not invariable. It is, obvious that the axis ratio (L2/L1) may be varied depending the factors including the physical properties of the liquid-ejecting head, such as dimensions, shape, and ink-eject operating condition, and the physical characteristic of ink. Therefore, it will be obvious to those skilled in the art that many modifications and variations of the above embodiment are possible to provide a more appropriate configuration thereof.

Other

The present invention achieves distinct effect when applied to a printing head or a printing apparatus which has means for generating thermal energy such as electrothermal transducers or laser light, and which causes changes in ink by the thermal energy so as to eject ink. This is because such a system can achieve a high density and high resolution printing.

A typical structure and operational principle thereof is disclosed in U.S. Pat. Nos. 4,723,129 and 4,7404,796, and it is preferable to use this basic principle to implement such a system. Although this system can be applied either to on-demand type or continuous type ink jet printing systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to printing information; second, the thermal energy induces sudden temperature rise that exceeds the nucleate boiling so as to cause the film boiling on heating portions of the printing head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better printing.

U.S. Pat. Nos. 4,558,333 and 4,459,600 disclose the following structure of a printing head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 59-123670 (1984) and 59138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the printing head, the present invention can achieve printing positively and effectively.

The present invention can be also applied to a so-called full-line type printing head whose length equals the maximum length across a printing medium. Such a printing head may consists of a plurality of printing heads combined together, or one integrally arranged printing head.

In addition, the present invention can be applied to various serial type printing heads: a printing head fixed to the main assembly of a printing apparatus; a conveniently replaceable chip type printing head which, when loaded on the main assembly of a printing apparatus, is electrically connected to the main assembly, and is supplied with ink therefrom; and a cartridge type printing head integrally including an ink reservoir.

It is further preferable to add a recovery system, or a preliminary auxiliary system for a printing head as a constituent of the printing apparatus because they serve to make the effect of the present invention more reliable. Examples of the recovery system are a capping means and a cleaning means for the printing head, and a pressure or suction means for the printing head. Examples of the preliminary auxiliary system are a preliminary heating means utilizing electrothermal transducers or a combination of other heater elements and the electrothermal transducers, and a means for carrying out preliminary ejection of ink independently of the ejection for printing. These systems are effective for reliable printing.

The number and type of printing heads to be mounted on a printing apparatus can be also changed. For example, only one printing head corresponding to a single color ink, or a plurality of printing heads corresponding to a plurality of inks different in color or concentration can be used. In other words, the present invention can be effectively applied to an apparatus having at least one of the monochromatic, multicolor and full-color modes. Here, the monochromatic mode performs printing by using only one major color such as black. The multi-color mode carries out printing by using different color inks, and the full-color mode performs printing by color mixing.

Furthermore, although the above-described embodiments use liquid ink, inks that are liquid when the printing signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the printing medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the printing signal. In such cases, the ink may be retained in recesses or through holes formed in a porous sheet as liquid or solid substances so that the ink faces the electrothermal transducers as described in Japanese Patent Application Laying-open Nos. 54-56847 (1979) or 60-71260 (1985). The present invention is most effective when it uses the film boiling phenomenon to expel the ink.

Furthermore, the ink jet printing apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A method of ejecting liquid by using a liquid-ejecting head comprising an orifice plate with an orifice for ejecting liquid, a substrate provided substantially parallel to the orifice plate and having energy-generating means for generating thermal energy to be used for generating a bubble to eject the liquid from the orifice, and a liquid-flowing path formed between the orifice plate and the substrate and communicating with the orifice so as to supply the liquid from a liquid chamber to the orifice, said method comprising the steps of:

generating the bubble using the energy-generating means for forming a flow of liquid that flows toward the liquid chamber and a flow of liquid that flows toward the orifice in a flow area shifted to a side of the liquid chamber such that an amount of liquid flowing to the orifice becomes substantially uniform around an inner peripheral surface of the orifice at a time of ejecting the liquid;

deforming a part of an interface between the liquid and the bubble formed in the liquid so that the interface contacts the substrate; and communicating the bubble with the atmosphere after the step of deforming the interface.

2. A method of ejecting liquid as claimed in claim 1, wherein, in the liquid-ejecting head, the energy-generating means has a heating portion on a side of the liquid chamber which is broader than a heating portion on a side opposite the liquid chamber with respect to a projected point where a centroid of a cross section of the orifice in parallel with the substrate is projected on the substrate.

3. A method of ejecting liquid as claimed in claim 2, wherein the projected point is defined as an origin of a coordinate system wherein a y-axis is defined as a line extending from the origin in a direction toward the liquid chamber and an x-axis is defined as a line perpendicular to the y-axis, and a heating region of the energy-generating means is in a shape of a rectangle, an area of a portion of the energy-generating means in a region where $y<0$ is defined as "S1" and an area of another portion of the energy-generating means in a region where $y \geqq 0$ is defined as "S2", wherein the relationship between "S1" and "S2" is represented by the following mathematical expression:

$$S2/S1>1.3.$$

4. A method of ejecting liquid as claimed in claim 1, wherein, in the liquid-ejecting head, an end wall of the liquid-flowing path is formed on a side opposite the liquid chamber with respect to a projected point where a centroid of a cross section of the orifice in parallel with the substrate is projected on the substrate.

5. A method of ejecting liquid as claimed in claim 1, wherein, in the liquid-ejecting head, the liquid-flowing path is formed in plural units and the liquid chamber is a common liquid chamber communicating with the plurality of liquid-flowing paths.

6. A method of ejecting liquid as claimed in claim 1, wherein, in the liquid-ejecting head, the energy-generating means is an electrothermal converter that generates thermal energy for causing a bubble in liquid by heating liquid through use of a film-boiling phenomenon.

7. A method of ejecting liquid as claimed in claim 1, wherein the communicating step is performed in the liquid-flowing path to communicate the bubble with the atmosphere.

8. A liquid-ejecting printing apparatus for printing an image on a printing medium by using the liquid-ejecting method of claim 1, comprising:

means for moving the liquid-ejecting head and the printing medium relatively to each other; and means for supplying a driving signal to the liquid-ejecting head.

9. A method of ejecting liquid by using a liquid-ejecting head comprising an orifice plate with an orifice for ejecting liquid, a substrate provided substantially parallel to the orifice plate and having energy-generating means for generating thermal energy to be used for generating a bubble to eject the liquid from the orifice, and a liquid-flowing path formed between the orifice plate and the substrate and communicating with the orifice so as to supply the liquid from a liquid chamber to the orifice, said method comprising the steps of:

generating the bubble using the energy-generating means for forming a flow of liquid that flows toward the liquid chamber and a flow of liquid that flows toward the orifice in a flow area shifted to a side of the liquid chamber such that a thickness of a liquid membrane is uniformly formed along an inner peripheral surface of the orifice at the time of ejecting the liquid;

deforming a part of an interface between the liquid and the bubble formed in the liquid so that the interface contacts the substrate; and communicating the bubble with the atmosphere after the step of deforming the interface.

10. A method of ejecting liquid as claimed in claim 9, wherein, in the liquid-ejecting head, the energy-generating means has a heating portion on a side of the liquid chamber which is broader than a heating portion on a side opposite the liquid chamber with respect to a projected point where a centroid of a cross section of the orifice in parallel with the substrate is projected on the substrate.

11. A method of ejecting liquid as claimed in claim 10, wherein the projected point is defined as an origin of a coordinate system wherein a y-axis is defined as a line extending from the origin in a direction toward the liquid chamber and an x-axis is defined as a line perpendicular to the y-axis, and a heating region of the energy-generating means is in a shape of a rectangle, an area of a portion of the energy-generating means in a region where $y<0$ is defined as "S1" and an area of another portion of the energy-generating means in a region where $y \geqq 0$ is defined as "S2", wherein the relationship between "S1" and "S2" is represented by the following mathematical expression:

$$S2/S1>1.3.$$

12. A method of ejecting liquid as claimed in claim 9, wherein, in the liquid-ejecting head, an end wall of the liquid-flowing path is formed on a side opposite the liquid chamber with respect to a projected point where a centroid of a cross section of the orifice in parallel with the substrate is projected on the substrate.

13. A method of ejecting liquid as claimed in claim 9, wherein, in the liquid-ejecting head, the liquid-flowing path is formed in plural units and the liquid chamber is a common liquid chamber communicating with the plurality of liquid-flowing paths.

14. A method of ejecting liquid as claimed in claim 9, wherein, in the liquid-ejecting head, the energy-generating means is an electrothermal converter that generates thermal energy for causing a bubble in liquid by heating liquid through use of a film-boiling phenomenon.

15. A method of ejecting liquid as claimed in claim 9, wherein the communicating step is performed in the liquid-flowing path to communicate the bubble with the atmosphere.

16. A liquid-ejecting printing apparatus for printing an image on a printing medium by using the liquid-ejecting method of claim 9, comprising:

means for moving the liquid-ejecting head and the printing medium relatively to each other; and means for supplying a driving signal to the liquid-ejecting head.

* * * * *

UNITED STATES PATENT AND TRADEMARK OFFICE

CERTIFICATE OF CORRECTION

PATENT NO. : 6,527,376 B1
DATED : March 4, 2003
INVENTOR(S) : Tamon Itaya et al.

It is certified that error appears in the above-identified patent and that said Letters Patent is hereby corrected as shown below:

Title page,
Item [57], ABSTRACT,
Line 14, "portions" should read -- portion --.

Column 1,
Line 33, "is defined" should be deleted;
Line 42, "existed" should be deleted;
Line 48, "even though" should read -- due to --; and
Line 58, "is occurred." should read -- occurs. --.

Column 2,
Line 36, "communicated" should read -- communicating --; and
Line 53, "printing," should read -- printing --.

Column 4,
Line 53, "in" should read -- as a --;
Line 54, "straight" should read -- straight line --;
Line 56, "babble" should read -- bubble --; and
Line 60, "a" should be deleted.

Column 6,
Line 17, "vies" should read -- views --;
Line 25, "the-reasons of" should read -- the reasons for --; and
Line 60, "EMBODIMENT" should read -- EMBODIMENTS --.

Column 7,
Line 35, "tart" should read -- part --.

Column 8,
Line 14, "easily," should read -- easily --;
Line 15, "becomes to communicate" should read -- communicates --;
Line 29, "in" should be deleted;
Line 36, "becomes to commu-" should read -- communicates --;
Line 37, "nicate" should be deleted;
Line 41, "existed" should read -- which exists --; and "is disappeared," should read -- disappears, --;
Line 44, "short" should read -- short in --;
Line 56, "bust" should read -- burst --; and
Line 60, "n" should be deleted.

UNITED STATES PATENT AND TRADEMARK OFFICE

CERTIFICATE OF CORRECTION

PATENT NO. : 6,527,376 B1
DATED : March 4, 2003
INVENTOR(S) : Tamon Itaya et al.

It is certified that error appears in the above-identified patent and that said Letters Patent is hereby corrected as shown below:

Column 9,
Lines 3 and 15, "hater" should read -- heater --;
Line 21, "in" (first occurrence) should be deleted; and
Line 51, "row" should read -- rows --.

Column 10,
Line 20, "Fist" should read -- First --; and
Line 31, "define's" should read -- defines --.

Column 11,
Line 10, "deferent" should read -- different --;
Line 51, "ya 1.5 $\mu$m," should read -- ya=1.5 $\mu$m, --; and
Line 57, "is" (first occurrence) should read -- has --.

Column 12,
Line 15, "'shaped" should read -- shaped --;
Line 42, "Ly 42.0 $\mu$m" should read -- Ly=42.0 $\mu$m --;
Line 46, "losses" should read -- loses --;
Line 50, "Secondary," should read -- Secondly, --;
Line 53, "reason," should read -- reasons, --;
Line 54, "than" should be deleted; and
Line 57, "become to" should read -- begin to --.

Column 13,
Line 11, "thick" should read -- thickness --;
Line 31, "head" should read -- heads --;
Line 42, "t he" should read -- the --; and
Line 47, "is" should be deleted.

Column 14,
Line 1, "is" (first occurrence) should read -- has --;
Line 6, "they-coordinate" should read -- the y-coordinate --; and
Line 18, "is" should read -- has --.

Column 15,
Line 41, "a" should read -- a liquid --; and
Line 54, "ejectedroplets" should read -- eject droplets --.

UNITED STATES PATENT AND TRADEMARK OFFICE

CERTIFICATE OF CORRECTION

PATENT NO. : 6,527,376 B1
DATED : March 4, 2003
INVENTOR(S) : Tamon Itaya et al.

It is certified that error appears in the above-identified patent and that said Letters Patent is hereby corrected as shown below:

Column 16,
Line 19, "means" should read -- means. --; and "but not limited" should be deleted; and
Line 20, "to." should be deleted.

Column 18,
Line 1, "Sulfonic" should read -- sulfonic --; and
Line 57, "does" should read -- is --.

Column 19,
Line 30, "has" should read -- is --;
Line 32, "a photolithography," should read -- photolithography; --;
Line 65, "shift" should read -- shifts --; and
Line 66, "allows" should read -- arrows --.

Column 20,
Line 22, "Embodiment" should read -- Third Embodiment --; and
Line 26, "is" should read -- are --.

Column 21,
Line 12, "water" should read -- water. --;
Line 14, "between-the" should read -- between the --; and
Line 25, "def-" should read -- diff- --.

Column 22,
Line 4, "bubbler 6 is" should read -- bubble 6 has --;
Line 25, "being" should read -- having --;
Line 28, "observation" should read -- observations --;
Line 64, "mean" should read -- means --; and
Line 66, "an" should read -- a --.

Column 23,
Line 14, "at the" should read -- is increased at the --;
Line 61, "microscopy" should read -- microscope --; and
Line 64, ""L2"" should read -- "L2", --; and ""A2"" should read -- "A2", --.

Column 24,
Lines 17 and 20, "Case" should read -- Cases --;
Line 31, "is" should read -- has --.

UNITED STATES PATENT AND TRADEMARK OFFICE

CERTIFICATE OF CORRECTION

PATENT NO. : 6,527,376 B1
DATED : March 4, 2003
INVENTOR(S) : Tamon Itaya et al.

It is certified that error appears in the above-identified patent and that said Letters Patent is hereby corrected as shown below:

Column 25,
Line 8, "mean" should read -- means --;
Line 10, "an" should read -- a --;
Line 33, "they-coordinate" should read -- the y-coordinate --;
Line 35, "of" should be deleted;
Line 41, "microscopy" should read -- microscope --;
Line 55, "burst." should read -- burst --; and
Line 56, "is" should read -- has --.

Column 27,
Line 20, "59138461" should read -- 59-138461 --.

Column 28,
Line 5, "in the" should read -- at --; and
Line 15, “evaporation:” should read -- evaporation; --.

Signed and Sealed this

Sixteenth Day of December, 2003

JAMES E. ROGAN
*Director of the United States Patent and Trademark Office*